US006170268B1

(12) United States Patent
Elfert et al.

(10) Patent No.: US 6,170,268 B1
(45) Date of Patent: Jan. 9, 2001

(54) METHOD AND APPARATUS FOR AUTOMATICALLY HYDRATING, FREEZING AND PACKAGED HYDRATION MATERIAL

(75) Inventors: Guenther Ernst Elfert, Langley; Hans-Ulrich Elfert, Vancouver, both of (CA)

(73) Assignee: Weyerhaeuser Company, Federal Way, WA (US)

( * ) Notice: Under 35 U.S.C. 154(b), the term of this patent shall be extended for 0 days.

(21) Appl. No.: 09/162,240

(22) Filed: Sep. 28, 1998

(51) Int. Cl.[7] ..... F25D 13/06
(52) U.S. Cl. ..... 62/63; 62/320; 62/380
(58) Field of Search ..... 62/62, 63, 64, 62/320, 373, 374, 380, 322; 252/70

(56) References Cited

U.S. PATENT DOCUMENTS

| | | | | |
|---|---|---|---|---|
| 3,802,220 | | 4/1974 | Pompo | 62/530 |
| 4,311,022 | | 1/1982 | Hall | 62/372 |
| 4,556,055 | | 12/1985 | Bonner, Jr. | 128/82.1 |
| 4,908,248 | | 3/1990 | Nakashima et al. | 428/355 |
| 5,135,787 | | 8/1992 | Bair | 428/36.1 |
| 5,150,707 | | 9/1992 | Anderson | 128/402 |
| 5,218,829 | * | 6/1993 | Dejarnette, Jr. | 62/63 |
| 5,339,796 | * | 8/1994 | Manker | 126/263.03 |
| 5,391,198 | | 2/1995 | Cheney, III et al. | 607/114 |
| 5,649,409 | | 7/1997 | Gujer et al. | 53/461 |
| 5,860,282 | * | 1/1999 | Liberman et al. | 62/63 |
| 5,966,962 | | 10/1999 | Murray et al. | 62/374 |

* cited by examiner

*Primary Examiner*—William E. Tapolcai
(74) *Attorney, Agent, or Firm*—Christensen O'Connor Johnson & Kindness PLLC

(57) ABSTRACT

This application relates to a novel method and apparatus for hydrating, freezing and cutting packaged hydration material. More particularly, this invention pertains to a novel method and apparatus for drawing unhydrated sandwich packaged hydration gel material from a roll of such material, hydrating the material in a hydration tank, freezing the hydrated material in a freezing chamber, and cutting the frozen hydrated material into pieces according to prescribed lengths. A process of continuously hydrating, freezing and cutting a hydratable polymer containing web of material which comprises: (a) passing the web into a water hydration vessel for sufficient time to hydrate the hydratable polymer; (b) withdrawing the web from the hydration vessel and passing the web through a freezer for sufficient time to enable the web to freeze; and (c) withdrawing the frozen web from the freezer and cutting the frozen web into prescribed lengths.

21 Claims, 15 Drawing Sheets

METHOD AND APPARATUS FOR AUTOMATICALLY HYDRATING, FREEZING AND PACKAGED HYDRATION MATERIAL

FIELD OF THE INVENTION

This application relates to a novel method and apparatus for hydrating, freezing and cutting packaged hydration material. More particularly, this invention pertains to a novel method and apparatus for drawing unhydrated material from a roll of such material, hydrating the material in a hydration tank, freezing the hydrated material in a freezing chamber, and cutting the frozen hydrated material into pieces according to prescribed lengths.

BACKGROUND OF THE INVENTION

For many years, it has been well known that the fresh taste and quality of fruit and vegetables can be preserved in reasonably good condition for extended periods of time by keeping the fruit and vegetables in chilled or refrigerated condition. When fresh fruits and vegetables are shipped from the source to the consuming marketplace, it has been customary for many years to pack the chilled fruit and vegetables in ice, or some other chilling medium. A problem with ice is that when it thaws, it converts to water, which can be a nuisance and often causes water damage.

In recent years, it has become the practice to utilize cooling packs of gel as an alternative to ice. Such cooling packs are used for chilling fruits and vegetables and also for treatment of sports injuries. A number of patents have issued in recent years directed to various designs of alternative cooling packs.

U.S. Pat. No. 3,802,220, granted Apr. 9, 1974, Pompo, assigned to Cool-Pack Corp., discloses a cooling pack constructed of a quilt-like sheet comprising two layers of polyethylene defining a plurality of small containers joined together through bonded container boundary zones, each container serving as a cooling cushion by reason of being filled with a pre-cooled stiff gel which has not frozen rigid, but which has a gel-like temperature range of at least 30° F., desirably about 60° F. Each such flexible container not only provides cooling but it can provide some cushioning and protection from impact. The composition of the gel has a rigid freezing point lower than about −40° F., desirably lower than −60° F., and consists of a mixture of 20 to 55 percent by weight amide of an acid having a molecular weight of at least 200, from 30 to 65 percent by weight of an organic water-miscible liquid having at least one hydroxyl group and a molecular weight less than 100, and from 15 to 50 percent by weight of water. The cushions can also have other shapes.

U.S. Pat. No. 4,311,022, issued Jan. 19, 1982, Hall, discloses an ice pack which is constructed of a plurality of separate compartments which are connected together through a webbing assembly. Each of the compartments is movable in respect to each other thereby permitting the ice pack to be located within confined various sizes of spaces. Each compartment of the ice pack contains a quantity of freezable substance which is used as a refrigerant. Each compartment is enclosed by a wall assembly which retards the accumulation of moisture on the exterior surface of the wall assembly.

U.S. Pat. No. 4,556,055, issued Dec. 3, 1985, Bonner, Jr., discloses a cold compress bandage defined by a layer of closed cell foam polymeric material sandwiched between and bonded to adjacent layers of fabric. One of the layers of fabric is absorbent with respect to aqueous liquids and is adapted to be in contact with an area of the body. A plurality of straps are releasably attached to the bandage to form a compress. The straps facilitate adjustment of the compress. Optionally, a plurality of elongated pockets may be sewn to the fabric layer opposite the absorbent layer for insertion of straps to form a brace or provide for additional cooling. Electrodes may be incorporated into the bandage to provide electrical stimulation.

U.S. Pat. No. 4,908,248, issued Mar. 13, 1990, Nakashima et al., discloses a cooling pack for cooling objects in the proximity thereof. The cooling pack consists of a single pouch or a plurality of continuous pouches, wherein each pouch has at least one face being made of water-permeable material and has sealed therein a hygroscopically swelling material. The sealed material of the cooling device before being chilled in a freezer or freezing compartment is not hygroscopically swelled and is not voluminous so that it can be decreased in weight by reducing the quantity of the sealed material which can improve the transportation efficiency, thereby resulting in lowered transportation costs. Furthermore, the device can be easily and securely attached to any body part or object such as the shoulder of a man or a beer bottle.

U.S. Pat. No. 5,135,787, issued Aug. 4, 1992, Bair, discloses an iced food shipping container and a novel aqueous liquid absorbing pad for use therein. The pad comprises superabsorbing polymer particles distributed in a polyester carded web contained between hydrophillic fabric outer layers. The pad can absorb more than 100 times its dry weight in water and other aqueous liquids that form during iced food shipment.

U.S. Pat. No. 5,150,707, issued Sep. 29, 1992, Anderson, discloses a thermal pack having a high heat-retention character, which may be quickly heated or chilled. The pack consists of an absorbent package having a gel-forming synthetic organic resin in particulate form deposited on an adhesive-coated substrate disposed between a pair of fibrous non-woven porous filter layers and covered on the outside by a pair of paper-like plies of non-woven porous absorbent material. The outside covers are seamed together around their periphery to form a closed envelope. The thermal pack may be positioned in a pouch which is adapted to be held in place over the afflicted area of the body by releasable fastening means. The pack and pouch are formed of a porous material which is capable of being heated in a microwave oven or cooled in a freezer. In making the absorbent pack, a predetermined quantity of particulate gel-forming resinous material is deposited on the adhesive surface of the substrate, which is water-soluble so that in use, when the assembly is immersed in water, the gel-forming synthetic organic resinous material is free to expand as a gel and fill the envelope provided by the peripheral seaming.

U.S. Pat. No. 5,391,198, issued Feb. 21, 1995, Cheney, III, et al., discloses a reusable compress and a method of applying heat or cold to human or animal parts. The method involves saturating crystals of a water soluble acrylic polymer and a thickening agent through the porous fabric of the compress bag containing the acrylic polymer and the thickener. The compress is heated in warm water or a microwave oven or cooled in a cool environment such as a freezer. The compress is applied to a human or animal part to warm or cool the body part. When the compress is no longer needed, the gel is de-hydrated and the compress is easily stored for safe reuse.

U.S. Pat. No. 5,649,409, granted Jul. 22, 1997, Gujer et al., assigned to Thermarite Pty. Ltd., discloses an apparatus for manufacturing a flexible container which has particulate material located between two flexible web members. The apparatus comprises a first feed means suitably in the form of one or more drive roller assemblies for advancing a first flexible web member through the apparatus. A metering means suitably in the form of a metering roller having recesses on its peripheral face accommodates the particulate material and deposits the particulate material onto the first flexible web member. A second feed means suitably in the form of a roller assembly passes a second flexible web member over the first flexible web member containing the particulate material. A sealing means suitably comprising a roller assembly having one of the rollers including heated zones or portions along its external surface seals the first and second web members as they pass between the rollers. The web members are sealed together along areas corresponding to contact of the web members with the heated zones or portions. Using the apparatus, there can be formed flexible containers or sachets containing particulate material such as super absorbent polymer which can be immersed in water and subsequently frozen to be used as a heat exchange pad.

SUMMARY OF THE INVENTION

The invention is directed to a process of continuously hydrating, freezing and cutting a hydratable polymer containing web of material which comprises: (a) passing the web into a water hydration vessel for sufficient time to hydrate the hydratable polymer; (b) with-drawing the web from the hydration vessel and passing the web through a freezer for sufficient time to enable the web to freeze; and (c) withdrawing the frozen web from the freezer and cutting the frozen web into prescribed lengths.

The web can comprise a plurality of cells containing the hydration polymer and the cells can be counted before the web is passed into the hydration tank. The cells of the hydrated web can be counted after being withdrawn from the hydration tank and before being passed through the freezer.

Data regarding the counted cells can be transmitted to a microprocessor and the microprocessor can control the rate of entry of the web into and out of the hydration tank. The cells can be vibrated before being counted.

The hydrated and frozen web can be cut between adjacent hydrated cells of the web. The hydrated frozen web can pass through a bight zone before being cut into predetermined lengths.

The web can be passed between a pair of pinch rollers before passing into the hydration tank. The hydrated web, after it is withdrawn from the hydration tank, can be passed through the freezer on conveyors.

The cells of the frozen hydrated web can be counted and the count data can be directed to a microprocessor which can determine when the web should be cut. The web between adjacent hydrated cells can be centered by a centering member and a knife then cuts the web after it is centered.

The invention is also directed to an apparatus for continuously hydrating, freezing and cutting a hydratable polymer containing web which comprises: (a) a station from which an unhydrated web can be drawn; (b) a hydration tank through which the web drawn from the station is passed for sufficient time to hydrate the polymer in the web; (c) a freeze chamber associated with the hydration tank for freezing a web that has been hydrated in the hydration tank; and (d) a cutter for cutting the frozen hydrated web into prescribed lengths.

The apparatus can include a first counter which can count unhydrated cells formed in the web. The apparatus can include a pair of rollers which can withdraw the web from the station.

The apparatus can include a sprocket which can withdraw hydrated web from the hydration tank and transport the hydrated web into the freezer chamber. The sprocket can count the number of hydrated cells in the web and utilizing a microprocessor can coordinate the cell count for the hydrated web with the cell count for the unhydrated web, as counted by the first cell counter.

The freeze chamber can include a top conveyor, and at least one underlying conveyor, which can transport the hydrated web through the interior of the freeze chamber. The top conveyor can be treated with a release agent to deter wet hydrated web from adhering to the top conveyor. The underlying conveyor can be constructed of spaced and flexibly interconnected rods. The apparatus can include at least one freezer blower which can circulate frigid air within the interior of the freeze chamber.

The conveyors can travel on tracks. The tracks can include frictionless polymer slides on the top surfaces thereof to reduce friction between the conveyors and the tracks.

The cutter can include a blade which can cut the hydrated frozen web at an interface between adjacent hydrated frozen cells. The blade can be associated with a cell interface centering device. A sprocket can withdraw frozen hydrated web from the freeze chamber and transport the frozen hydrated web to the cutter.

The apparatus can include a cell counter which can count frozen hydrated cells and direct the cell count to the microprocessor, which can determine when the web should be cut.

DRAWINGS

In drawings which illustrate specific embodiments of the invention but which will not be construed as restricting the spirit or scope of the invention in any way:

FIG. 23 illustrates a detail side view of one end of the second and third underlying hydrated material conveyors in the freezing chamber.

DETAILED DESCRIPTION OF SPECIFIC EMBODIMENTS OF THE INVENTION

The method and apparatus of the invention draws non-hydrated hydration material available under the trade-mark DYNEFREEZE from Dynetherm, Inc., Theodore, Ala., a wholly owned subsidiary of Weyerhaeuser Company, from a large continuous roll and produces from the roll precisely hydrated and frozen sheets cut to selected sizes. The web of hydrated material is constructed of a first layer of polyester non-woven fibre, a second layer of waterproof polymer film, such as polyethylene, and granules of hydration acrylic polymer gel contained in discrete cells between the two layers. The process is performed in a continuous manner by threading a web of the non-hydrated material through three separate sections:

(1) A hydration tank in which the non-hydrated material is immersed in water for a precisely determined time to provide the desired degree of hydration to the polymer gel. Since the rate of hydration of the granules is temperature sensitive, and is also affected by degree of water hardness, water immersion times in the hydration tank are variable and can be controlled by appropriate instructions to a central microprocessor (PLC).

(2) A freezing section in which the web of hydrated material is frozen by travelling back and forth in a descending pattern along a stacked series of web conveyors in a freezer chamber with blast freeze blowers that circulate the frigid air through the stacked conveyors and the web of hydrated material.

(3) A cutting section in which the web of hydrated and frozen material exiting from the freezing section, is cut into panels of selected size by a knife driven by an air cylinder across the web between cells of hydrated frozen material.

Figure 1:
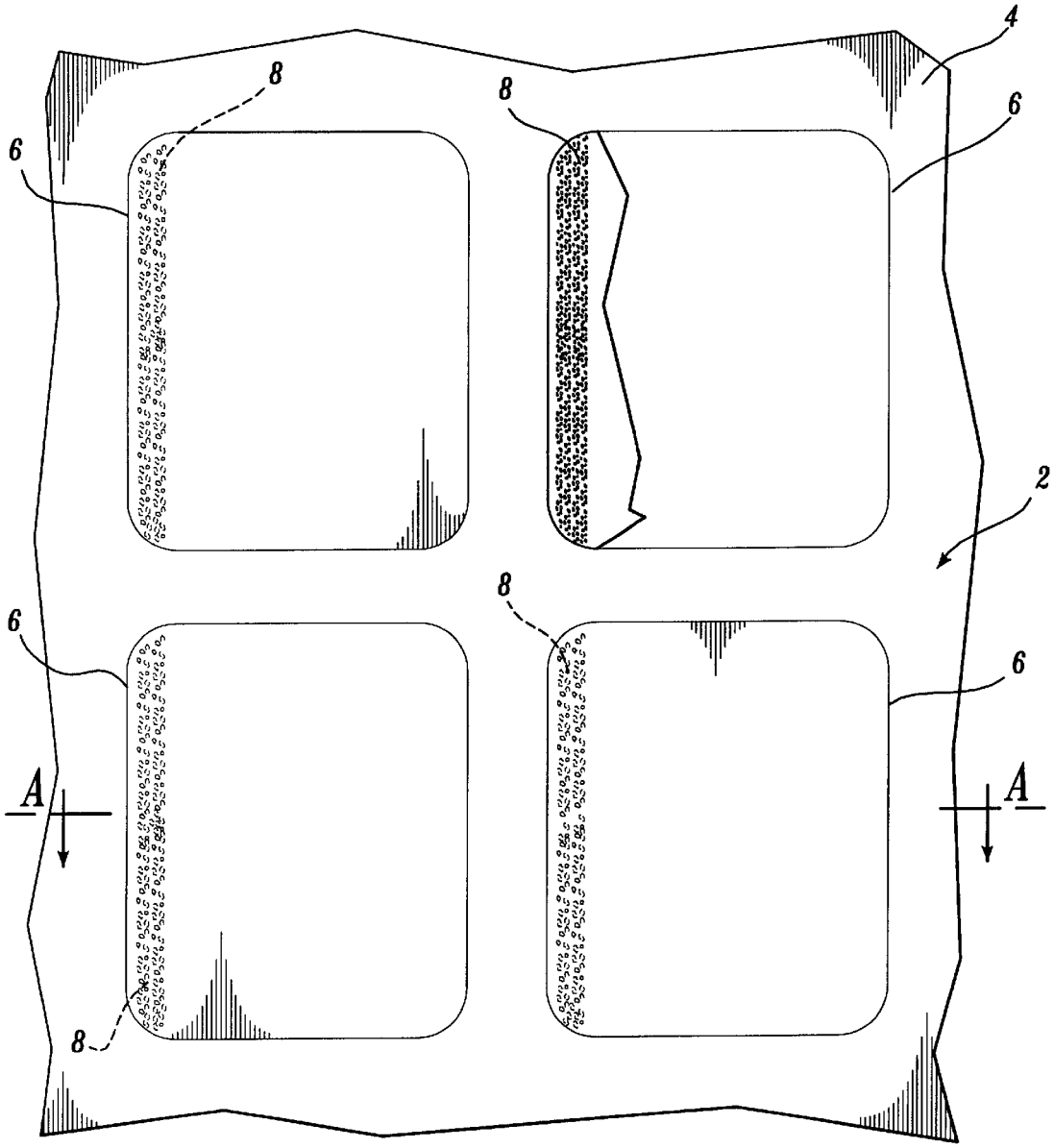
FIG. 1 illustrates a plan view of an unhydrated granulated hydration gel sandwich material.

Referring now to the drawings, which illustrate specific embodiments of the invention, FIG. 1 illustrates a plan view of an non- hydrated granulated hydration gel material 2. As seen in FIG. 1, which depicts merely a small portion of the overall web of hydration material 2 (which is typically produced in broad sheets and wound on rolls), the material 2 comprises (as seen in section in FIG. 2) a top layer of non-woven polyester fibre 4, and a bottom layer of waterproof polymer film 10, which are arranged to form a series of parallel and separated cells 6, each cell 6 containing a small amount of non-hydrated gel granules 8.

Figure 2:
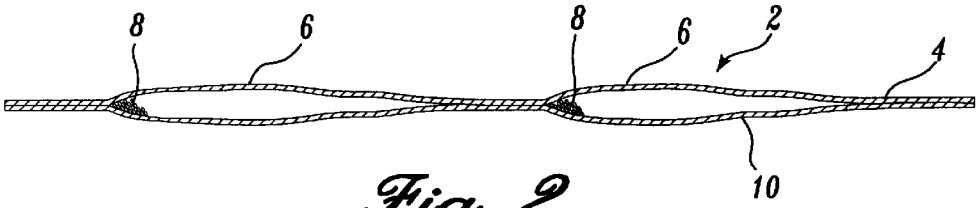
FIG. 2 illustrates a section view taken along section line A—A of FIG. 1, showing the unhydrated gel particles and the collapsed outer walls.

FIG. 2, which illustrates a section view taken along section line A—A of FIG. 1, shows the sandwich-like construction of the web of material 2 with the top layer of non-woven fibre 4, the bottom layer of polymer film 10, and the non-hydrated gel granules 8 contained in each cell 6. Only a small predetermined number of non-hydrated gel granules 8 are contained in each cell 6. The non-hydrated gel granules 8, which can be hydratable acrylic polymer or carboxymethylcellulose, when hydrated with water, swell considerably (as much as ten to fifty times), and accordingly swelling room must be provided in each cell 6. If there is not enough swelling room in each cell 6, the granules 8, when they are hydrated and swell, will burst the cell 6, which is undesirable because it ruins the purpose and performance of the material 2.

Figure 3:
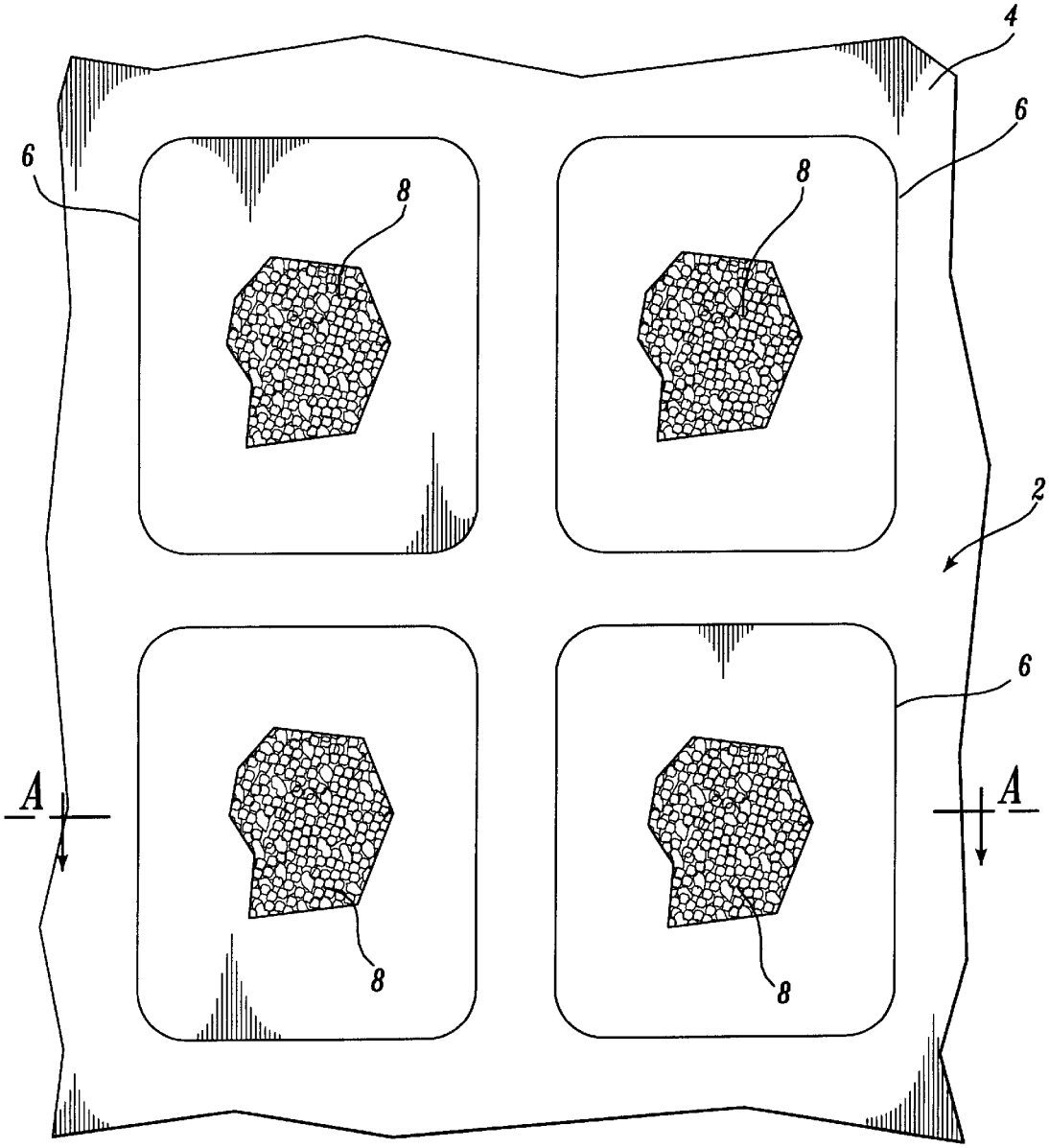
FIG. 3 illustrates a plan view of a hydrated sandwich material.
Figure 4:
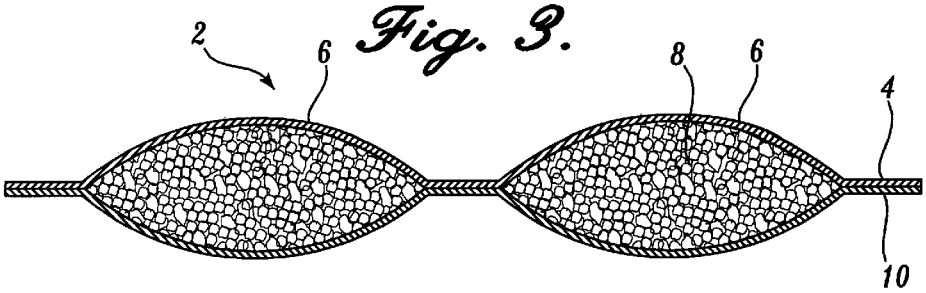
FIG. 4 illustrates a section view taken along section line A—A of FIG. 3, showing the gel hydrated and expanded.

FIG. 3 illustrates a plan view of the material 2 after the granules 8 have been fully hydrated (only a limited number of granules 8 are shown in each cell). The hydrated swollen granules 8 completely fill each cell 6, and lend an overall discrete pillow effect to the overall sandwich material 2. FIG. 4 illustrates a section view taken along section line A—A of FIG. 3, and shows the fully hydrated gel granules 8, completely filling each cell 6 between the top non-woven fibre layer 4 and the underlying polymer film layer 10.

Figure 5:
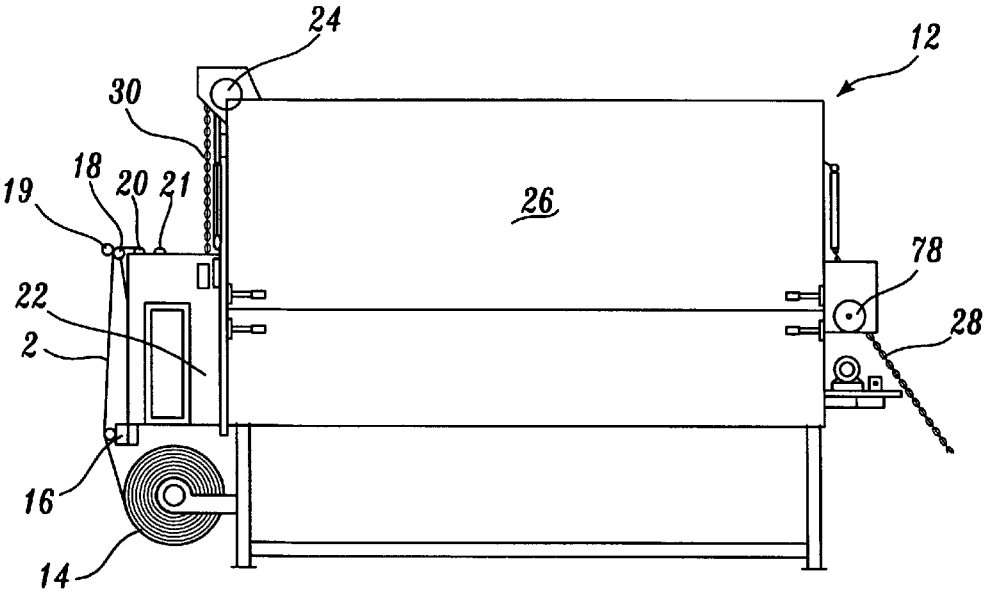
FIG. 5 illustrates an elevation view of a hydration-freezer apparatus according to the invention.

FIG. 5 illustrates an elevation view of a 100 lb./hr. hydration-freezer cutting apparatus, according to the invention. The hydration-freezer cutting apparatus 12 has on one side thereof a non-hydrated material roll 14, from which a layer of material 2 is unwound and drawn in an upwardly direction. The non-hydrated material 2 passes by a vibrator 16 which ensures that the gel granules 8 are shaken to the bottom of each cell 6 and form a cluster so that each cell 6 can be accurately counted. If the granules 8 remain spread out, the cells 6 are somewhat flat and indistinct and difficult to count. The material 2 is then drawn upwardly between an idle roller 18 and a biased pinching counting roller 19, which separates from idle roller 18 slightly as each cluster of gel granules 8 in each cell 6 passes between the two. Each separation of the counter roller 19 from the idle roller 18 indicates one cell count. The cell 6 count is transmitted from the counter wheel 19 to a central microprocessor (PLC) (not shown). After the material 2 with the plurality of cells 6 passes between the idle roller 18 and the counter roller 19, the material 2 is drawn over the top of the idle roller 18 and into a pair of drive and pinch rollers 20, 21.

It is important to know the number and rate of cells 6 that are delivered to the hydration tank 22 in order to establish proper and appropriate hydration times. Otherwise, control over hydration time will be lost, or is difficult to achieve. The cell 6 count is done by a proximity sensor (not shown). It is also important that the hydration tank 22 is not overloaded with hydration material 2. There must at all times be room for the hydration material 2 to expand on hydration.

After the material 2 has been fully hydrated by descending in pleats in the hydration tank 22 (see FIG. 14), the hydrated material (now numbered 30) is drawn out of the top of the tank 22 by a hydrated material handling sprocket 24, mounted at the top left corner of the hydration-freezer apparatus 12 (as seen in FIG. 5). The hydrated material 30 passes over the top of the handling sprocket 24 and downwardly through a slot 2 (see FIG. 9) into the freezer chamber 26. The material 30, which is now fully hydrated, makes a number of back and forth passes downwardly through the freezer chamber 26 (as will be explained in more detail below) and ultimately exits the outfeed end of the hydration freezer apparatus 12 as frozen hydrated material 28 (see FIG. 9).

Figure 6:
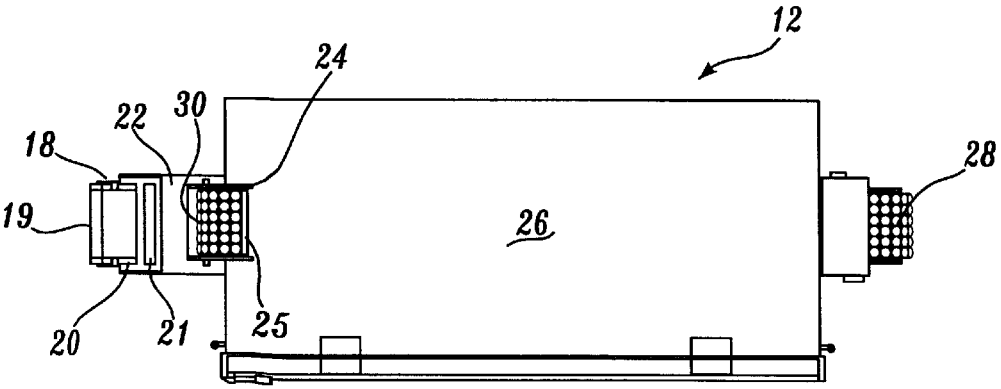
FIG. 6 illustrates a plan view of the hydration-freezer apparatus.

FIG. 6 illustrates a plan view of the hydration freezer apparatus 12. FIG. 6, in particular, illustrates the top of the freezer chamber 26, the top of the hydrated material handling sprocket 24, the slot 25 in the top of the freezer chamber 26 through which the hydrated material 30 passes downwardly into the freezer chamber 26, the pair of pinch rollers 20, 21, and the counter roller 19 and idle roller 18, mounted above the hydration tank 22.

Figure 7:
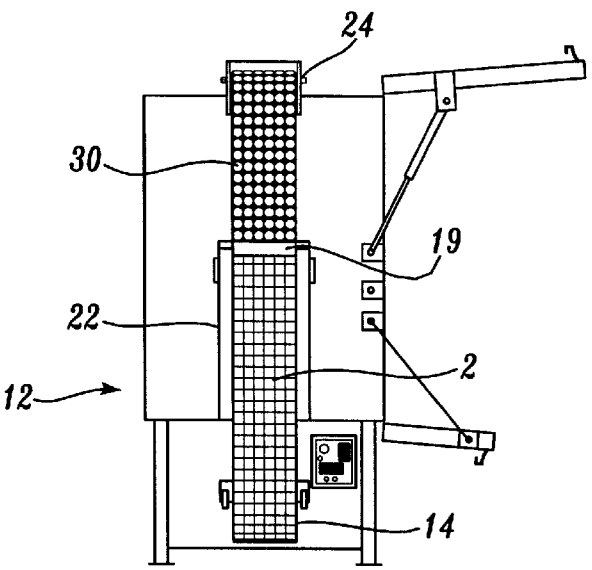
FIG. 7 illustrates an end view of the infeed end of the hydration-freezer apparatus.

FIG. 7 illustrates an end view of the infeed end of the hydration-freezer apparatus 12. As can be particularly seen in FIG. 7, the non-hydrated material 2 is drawn as a web sheet from roll 14 and asses in an upwardly direction past vibrator 16. It then passes between dle roller 18 and counter roller 19 before being delivered downwardly through the pinch rollers 20, 21 into the hydration tank 22. A typical rate for the non-hydrated material 2 into the hydration tank 22 is about 1 ft./min., for a 100 lb./hr. unit. Subsequently, the material 30, after it has been fully hydrated in the hydration tank 22, is drawn upwardly out of the hydration tank 22 and over hydrated material handling sprocket 24.

Figure 8:
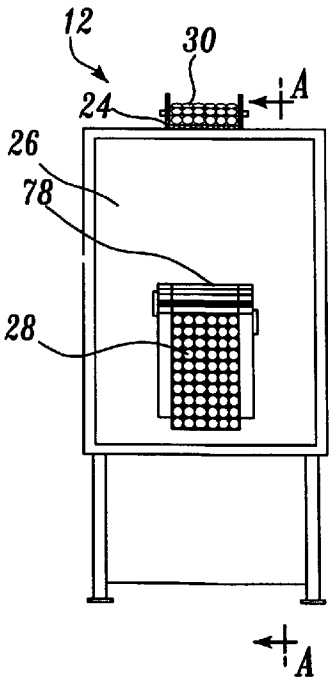
FIG. 8 illustrates an end view of the outfeed end of the hydration-freezer apparatus.

FIG. 8 illustrates an end view of the outfeed end of the hydration-freezer apparatus 12. The fully hydrated material 30 as it passes over material handling sprocket 24 can be seen at the top of FIG. 8, above the freezer chamber 26, while the exit for the frozen hydrated material 28 can be seen in the middle of the outfeed end of the apparatus 12. The infeed sprocket 24 must be located outside the freezer chamber 26 because otherwise it will ice up since it is handling and counting wet hydrated cells 6 in material 30.

Figure 9:
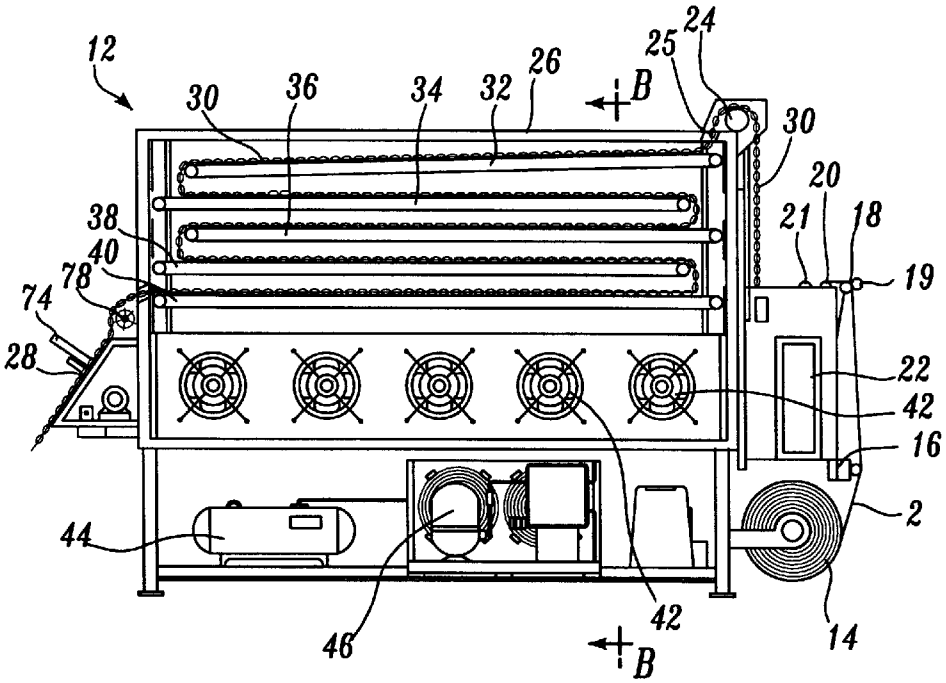
FIG. 9 illustrates a section view taken along section lines A—A of FIG. 8.

FIG. 9 illustrates a section view taken along section line A—A of FIG. 8. As seen in FIG. 9, the fully hydrated material 30, after it passes over handling sprocket 24, drops down through slot 25 onto the upstream end of the top surface of top conveyor 32. Top conveyor 32 is constructed differently than the underlying conveyors 34, 36, 38 and 40. The top surface of top conveyor 32 is a thin wide conveyor belt constructed of woven polyester fibre, with a smooth water impervious outer surface of silicone to prevent sticking. Accordingly, droplets of water dripping from the hydrated material 30 as it passes along the top of top conveyor 32 freeze on the top surface of the silicone treated conveyor 32 and drop off harmlessly as ice pellets when they reach the end of the top conveyor 32. If a release agent is not used, the wet hydrated material 30 would tend to adhere to the top surface of the conveyor 32 as it started to freeze and gradually freeze up the top conveyor. A shut down for ice cleaning would then be necessary.

After passing long the full length of top conveyor 32, the hydrated material 30 drops downwardly off the end of conveyor 32 onto the top surface of the upstream end of the second conveyor 34, which is below conveyor 32 and is travelling in the opposite direction. The hydrated material 30 then passes in a reverse direction along the top surface of second conveyor 34. The hydration material 30 conveyance process is repeated in switch-back fashion along the tops of third conveyor 36, underlying fourth conveyor 38, and finally underlying fifth conveyor 40.

Conveyors 34, 36, 38 and 40 are constructed differently than top conveyor 32. Conveyors 34, 36, 38 and 40 are constructed of a series of linked lateral crossbars of 18-8 stainless steel which are spaced apart. The openings between the lateral crossbars permit frigid air to readily circulate about the hydrated material 30 and assist the freezing process.

As the hydrated material 30 passes back and forth along the top surfaces of the series of conveyors 32, 34, 36, 38 and 40, the hydrated material 30 gradually freezes due to the sub zero temperatures maintained in the freeze chamber 26. Temperatures of −20° C. to −40° C. are typical in the freeze chamber 26. Super cooled air is circulated within the freeze chamber 26 by a series of blast freeze blowers 42. Five blast freeze blowers 42 are illustrated in FIG. 9. Suitable blowers 42 are available from Colmac Manufacturing Company, Coleville, Wash. FIG. 9 also illustrates a condenser 44, and a compressor 46, which are conventional in freezer systems and cool the air in the freeze chamber 26 to sub zero temperatures. The freeze chamber 26 is typically insulated on the inside walls by 4 inches of foamed in place rigid polyurethane foam. The foam is covered with polyester sheeting.

Figure 10:
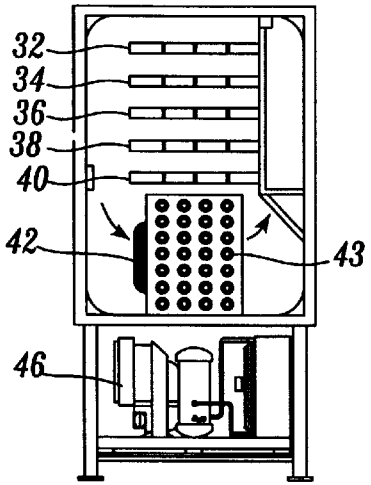
FIG. 10 illustrates a section view taken along section line B—B of FIG. 9.

FIG. 10 illustrates a section view taken along section line B—B of FIG. 9, and shows the top waterproof silicone treated conveyor 32, and the underlying stainless steel crossbar conveyors 34, 36, 38 and 40 stacked one above the other in spatial relation. The blast freeze blower 42 is located below the fifth conveyor 40 and circulates frigid air in a convection manner (as illustrated by the arrows) through the spaces between the stacked conveyors 32, 34, 36, 38 and 40. The frigid air is circulated repeatedly so it is not necessary to continuously chill warm ambient air. However, the hydrated material 30 releases heat as it undergoes freezing so the air has to be continuously chilled to a certain extent to maintain sub-zero temperatures. The air is chilled by the blower 42 blowing the air over conventional refrigerant cooling coils 43. It will be understood that more conveyors can be installed in the interior of the freeze chamber 26, in order to increase residence time of the hydrated material 30, as it passes through the interior of the freeze chamber 26 and is ultimately frozen. The overall capacity of the freeze chamber 26 can also be increased by adding more conveyors and additional freeze blowers. In reverse fashion, the number of conveyors and blowers can be decreased to accommodate different capacities.

Figure 11:
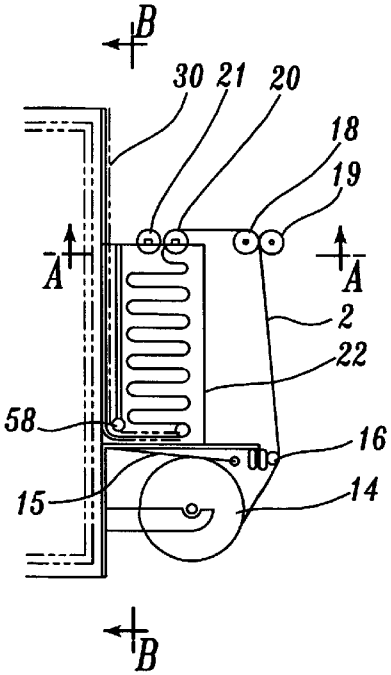
FIG. 11 illustrates a detailed elevation partial section view of the hydration tank and non-hydrated material roll.

FIG. 11 illustrates an elevation partial section view of the hydration tank 22 and non-hydrated material roll 14. As seen in FIG. 11, the non-hydrated material 2 is drawn upwardly from material roll 14 and passes by vibrator 16, which shakes the hydration gel granules to the bottom of each cell 6 in the material 2. A roll end detector 15 rides on the top of roll 14 and determines when the end of the material 2 is approaching and alerts the operator by activating an alarm. The operator can then move a new roll into position and attach it to the end of the old roll by duct tape or some other suitable material in order to keep the hydration and freezing process in continuous operation.

The material 2, after passing upwardly by vibrator 16, is drawn upwardly between counter roller 19 and idle roller 18. Cell counter roller 19 is electronically connected to a microprocessor (PLC) (not shown), in which the cell count data is stored and computed. The cell counted material 2 then passes over idle roller 18 in a horizontal direction to the pair of pinch rollers 20 and 21. Roller 20 is a drive roller, while roller 21 is an idle roller. The material 2 then passes downwardly through the pinch between rollers 20 and 21 and descends in a pleated pattern into the water held in the interior of hydration tank 22.

Figure 12:
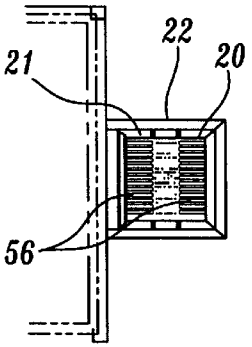
FIG. 12 illustrates a section view taken along section line A—A of FIG. 11.

FIG. 12 illustrates a section view taken along section line A—A of FIG. 11. FIG. 12 illustrates the top of the hydration tank 22, the adjacent edges of the drive roller 20 and the idle roller 21, and a series of opposing peel fingers 56 which are arranged in parallel comb-like manner below each of the rollers 20, 21. The peel fingers 56 ensure that the hydrated material 2 does not cling to the undersides of the rollers 20, 21 and passes downwardly into the water held in the hydration tank 22.

Figure 13:
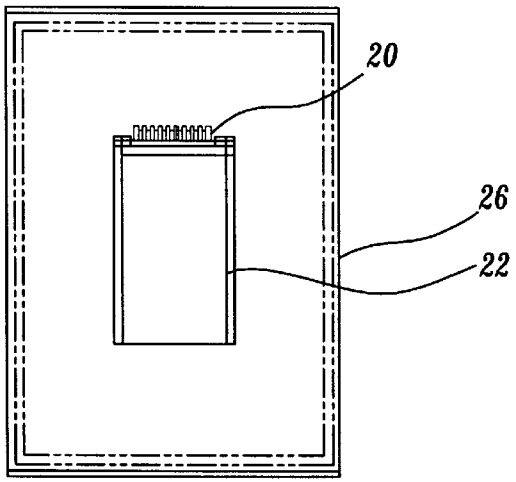
FIG. 13 illustrates a section view taken along section line B—B of FIG. 11.

FIG. 13 illustrates a section view taken along section line B—B of FIG. 11. A top portion of the grooved surface of the drive roller 20 is visible above the hydration tank 22. The freezer chamber 26 is located behind the hydration tank 22, as seen in FIG. 13.

Figure 14:
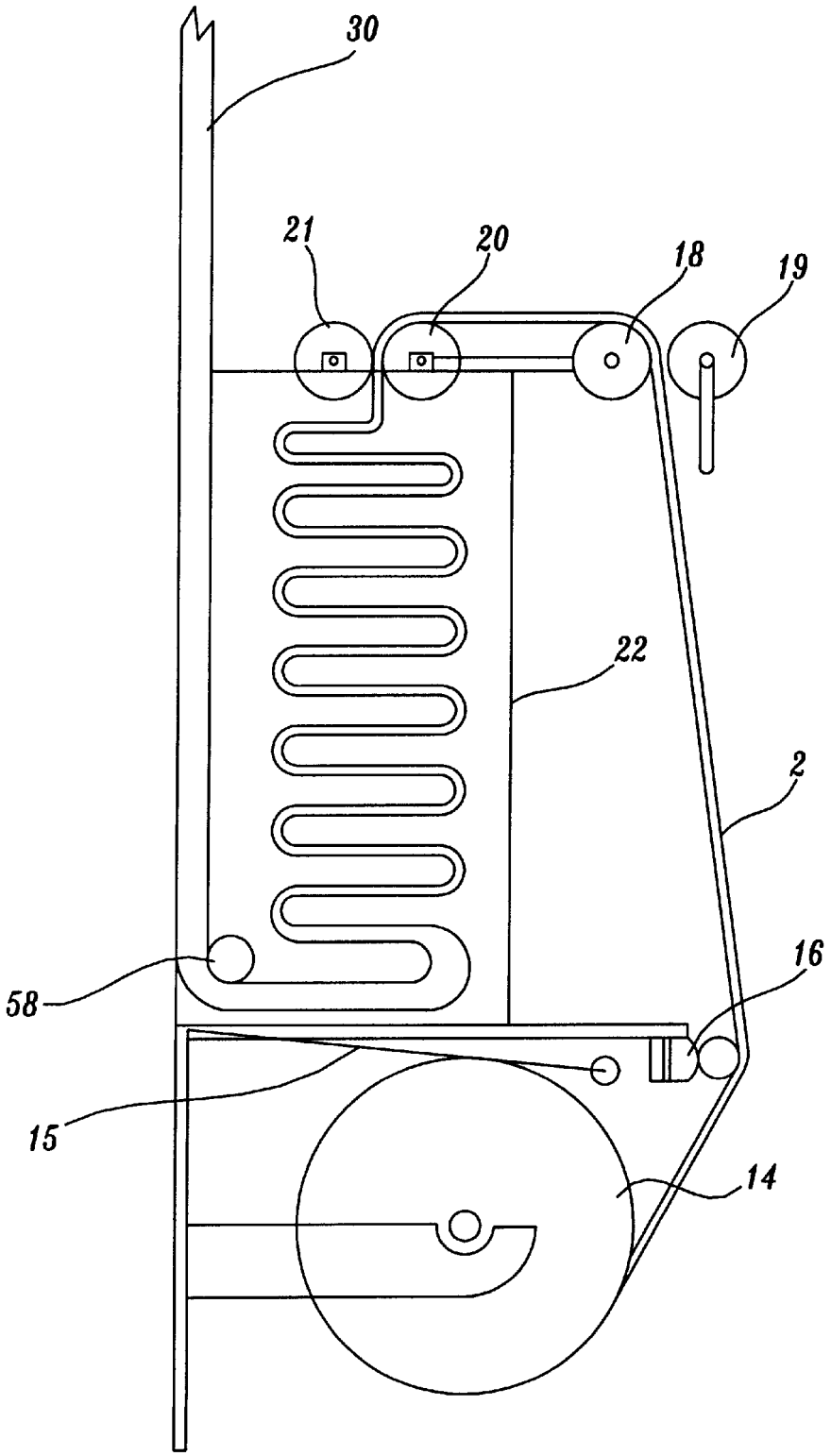
FIG. 14 illustrates an enlarged partial section elevation view of the hydration tank and non-hydrated material roll.

FIG. 14 illustrates an enlarged partial section elevation view of the hydration tank 22 and non-hydrated material roll 14. A challenging problem confronting the inventors was to accurately keep track of the cell count of the material 2 as it proceeds through the hydration and freezing process. One complication that was faced is that the granules 8 in the material 2 are spread throughout the cells 6 because prior to hydration, they occupy perhaps only 1 to 3% of the cell volume. Secondly, the granules 8 swell dramatically in volume when hydrated. This causes the cells 6 to swell and shorten in length. Thus the overall length of the material 2 also shortens as the granules 8 take on water and swell. The material 2, when finally hydrated, might shorten by as much as 10 to 15% per unit length (eg. from 12 inches to 10 inches). Because of this overall length shortening phenomenon, it was not possible to control the hydration process and the passage of the material 2 through the process simply by keeping track of the overall length of the material 2. A method of conducting cell counts accurately throughout the hydration process notwithstanding the length shortening factor had to be invented.

A solution to keeping accurate count of cells 6 throughout the hydration process was achieved by utilizing a combination of a vibrator 16 to shake the granules 8 into a compact countable group in each cell 6, a cell counter roller 19, and a hydrated cell counting sprocket 24, located at the top of the freeze chamber 26 (see FIG. 9). As seen in FIG. 14, which illustrates an enlarged partial section elevation view of the hydration tank 22 and non-hydrated material roll 14, the non-hydrated material 2 is drawn upwardly from the material roll 14 and passes by vibrator 16, as explained previously. The vibration caused by the vibrator 16 ensures that the hydration granules 8 are shaken to the bottom of each cell 6 and form a countable bulge in each cell. The material 2 is then drawn upwardly between idle roller 18 and counter roller 19, where a first cell count is made by the counter roller 19. The counter roller 19 counts the cells using a proximity sensor and conveys the information to a central microprocessor (PLC) (not shown). The material 2 then changes direction over roller 18 and passes horizontally over the top of drive roller 20, and downwardly through a nip between drive roller 20 and idle roller 21. The material 2 then descends in a pleat-like pattern into the water held in the hydration tank 22.

It is an important feature of the invention that the web of non-hydrated material 2 passes over the drive roller 20 with the non-woven polyester fibre layer 4 facing downwardly. The bottoms of the drive roller 20 and the idle roller 21 are immersed at all times in the hydration water (see FIG. 18 also) and are thus kept wet. This is important because the wet rollers 20, 21 cause a pinching action on the material 2 and thereby impart wetness to the polyester fibre layer 4. The pinch-wetting action of the drive roller 20, the idle roller 21 and the wet ribs 60 on the polyester fibre layer 4 squeezes water into the interstices between the polyester fibres and overcomes the inherent initial water repellency action of the polyester fibre layer 4. This pinch-wetting action ensures that water will readily penetrate through the fibre layer 4 to the granules 8 as the material 2 descends into the water in the tank 22 and initiate the hydration action. Once the water penetrates the polyester fibres 4, a natural capillary action is established and water continues to migrate from the tank 22 to the hydration gel granules 8 in each cell 6. The hydration gel granules 8 then start to swell and expand the spaces between the fibre layer 4 and the film layer 10. The gel hydration process then accelerates. As a general rule, the non-hydrated material 2 remains in the hydration tank 22 and travels downwardly in a pleat-like fashion for about 20 minutes.

As the material 2 descends gradually downwardly through the water held in the hydration tank 22, the hydration gel granules 8 held within the material 2 gradually hydrate and swell in size. As seen in FIG. 14, the material 2, as it descends downwardly in pleat-like manner in the hydration tank 22, gradually increases in thickness. Finally, when the hydrated material 2 reaches the bottom of the hydration tank 22, it passes under hold down weight roller 58 and upwardly out of the tank 22, and up to infeed sprocket 24, which is shown in FIG. 9.

Hold down weight roller 58 serves to ensure that the material 2 as it passes downwardly in the water in the hydration tank 22 travels to the bottom of the hydration tank 22 and has appropriate hydration residence time in the water in the tank 22 before the hydrated material 30 is withdrawn from the hydration tank 22. The roller 58 remains at the bottom of tank 22 during normal operation.

As a general rule, there are roughly 60 to 250 feet respectively of material 2 in the hydration tank 22 at any one time. The drive roller 20 is separately driven by a DC or AC variable speed motor at a speed which is controlled by the central microprocessor (PLC) according to cell count information received from the counter roller 19. The idle roller 21 rotates at the same rate as the drive roller 20. Because of the swelling of the material 2 as it hydrates while travelling downwardly in continuous manner in the hydration tank 22, the effective length of the material 2 shortens. The length of the material 2 as it enters the hydration tank 22 is longer than when it emerges from the hydration tank 22, approximately 20 to 30 minutes later. The material 2 has an initial entry rate of approximately 1 foot per minute, for a 100 lb./hr. unit.

Figure 16:
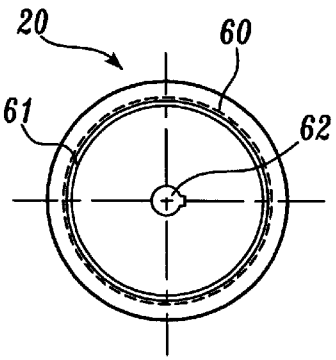
FIG. 16 illustrates an end view of the non-hydrated material drive feed roll illustrated in FIG. 15.
Figure 15:
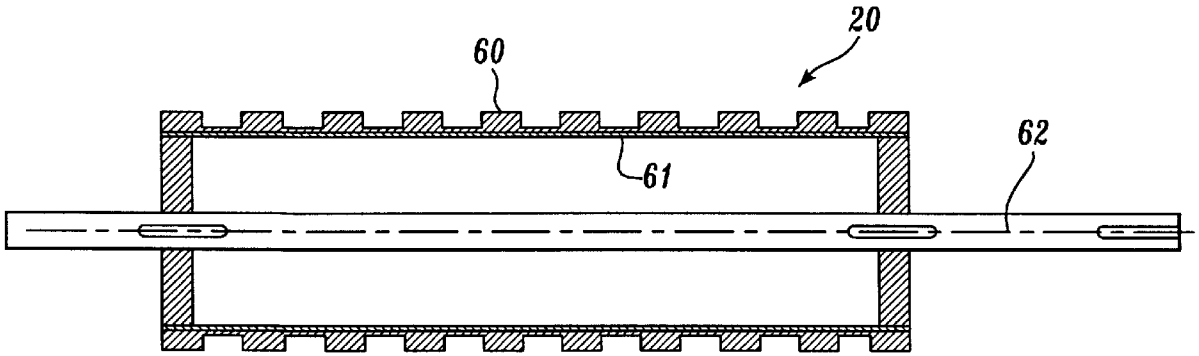
FIG. 15 illustrates an elevation section view of the non-hydrated material driver feed roll.

FIG. 15 illustrates an elevation section view of the non-hydrated material feed roller 20. As can be seen in FIG. 15, the roller 20 has distributed along the exterior surface thereof a series of circumferential rubber ribs 60 with grooves between the ribs 60. The rubber ribs 60 are typically vulcanized rubber and are formed or cemented on a metal undersurface 61 of the roller 20. The metal roller 61 and rubber ribs 60 rotate on shaft 62, which passes axially through the interior of the drive roller 20. FIG. 16 illustrates an end view of the drive roller 20, with the ribs 60, the underlying metal cylinder 61 and the shaft 62.

Figure 17:
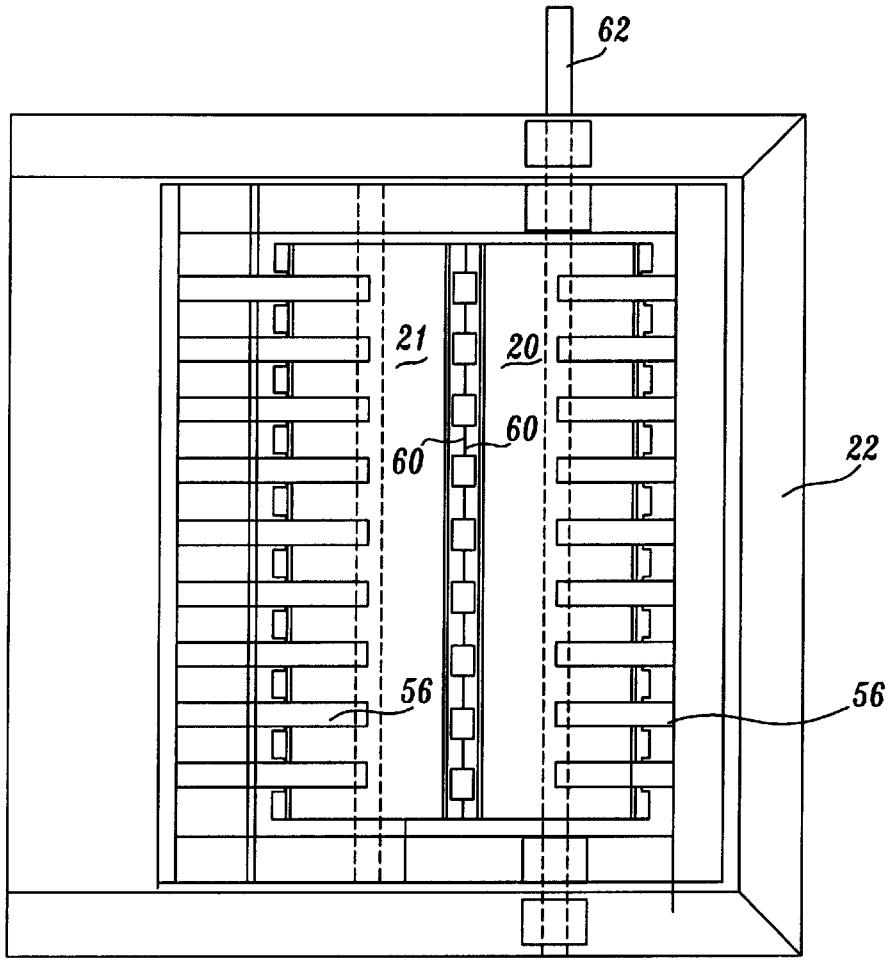
FIG. 17 shows an enlarged bottom view of the plurality of facing peel fingers underlying the pair of non-hydrated material feed rolls.

FIG. 17 illustrates a bottom enlarged view of the two facing sets of parallel peel fingers 56 underlying the pair of pinch rollers, namely drive roller 20 and idle roller 21. The complementary pair of peel fingers 56, 56 comprise two facing sets of parallel comb-like teeth, one set positioned under drive roller 20 and the other set under idle roller 21. Since the non-hydrated material 2 is light and dry, it has a tendency to float in water. The material 2 thus tends to resist descending into the water below the rollers 20 and 21. The function of the two sets of parallel peel fingers 56 is to ensure that the material 2 is separated from the wet rollers 20, 21. This ensures that the wetted material 2, after it passes downwardly through the wetting nip (pinch) between wet drive roller 20 and wet idle roller 21, does not continue to cling to the wet rollers 20 or 21. FIG. 17 also illustrates that the series of rubber ribs 60 on the drive roller 20 are coincident with and abut the complementary series of rubber ribs 60 on the idle roller 21. This ensures that a good wet pinch action is achieved on the material 2 as explained previously. The two sets of facing parallel peel fingers 56, 56 are positioned so that they extend into and travel in the grooves between the adjacent ribs 60 of the respective rollers 20 and 21. Thus, it is impossible for the wet material 2 to bypass the peel fingers 56.

Figure 18:
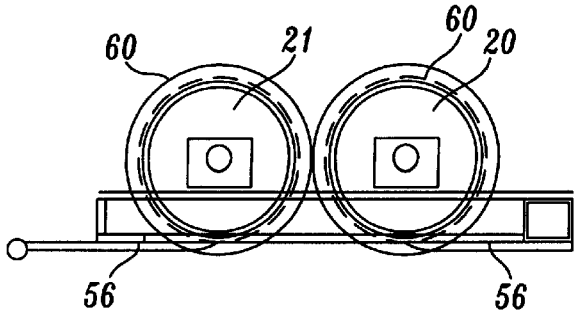
FIG. 18 illustrates an end view of the pair of adjacent non-hydrated material drive and idle feed rolls.

FIG. 18 illustrates an end view of the pair of adjacent non-hydrated material pinch rollers 20 and 21. The drive and idle rollers 20 and 21 have parallel axes and the rubber ribs 60 match with and abut each other, as explained above. Furthermore, as seen in FIG. 18, the free ends of the adjacent facing peel fingers 56, 56 extend into and travel in the bottoms of the grooves between the series of rubber ribs 60 on each roller 20, 21, thereby ensuring that the wetted material 2 cannot cling to the rollers 20, 21.

Figure 19:
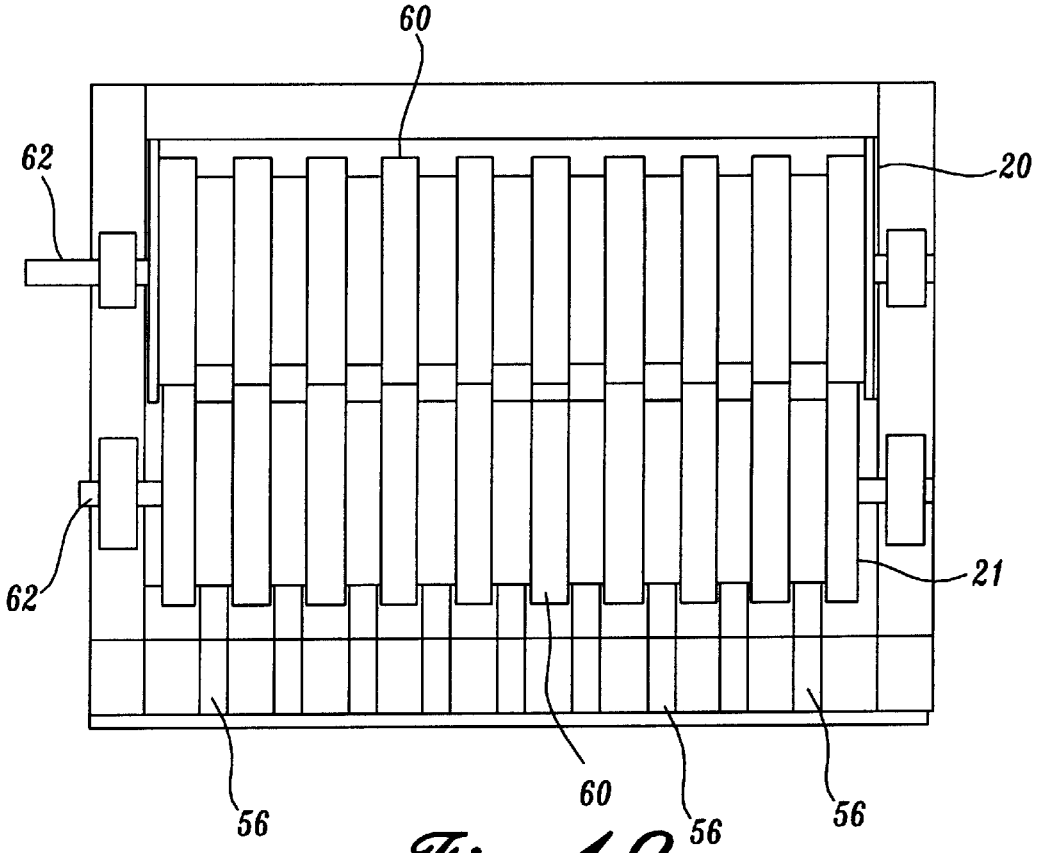
FIG. 19 illustrates a plan view of the pair of adjacent drive and idle feed rolls.

FIG. 19 illustrates a plan view of the pair of adjacent pinch rollers 20 and 21. The series of rubber ribs 60 of the feed drive roller 20 are aligned with and abut the respective series of rubber ribs 60 of the adjacent idle roller 21. The "pinch" force between the adjacent ribs 60 is empirically determined to provide an appropriate draw force on the non-hydrated material 2 and impart a proper wetting action on the polyester fibres 4 of the material 2. The pair of rollers 20 and 21 rotate on parallel shafts 62. FIG. 19 also illustrates how the series of parallel peel fingers 56 are arranged so that they are aligned with and extend into the grooves between the series of rubber ribs 60 of the feed roller 20, and the idle roller 21.

Figure 20:
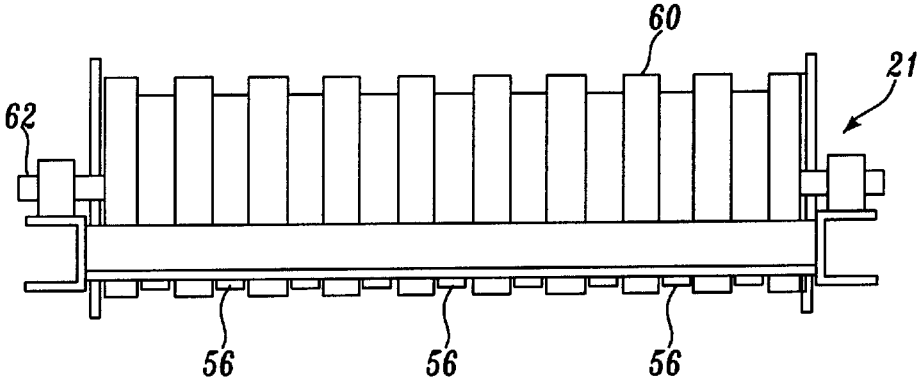
FIG. 20 illustrates an end view of the drive feed roll.

FIG. 20 illustrates an end view of the idle roller 21 with the series of rubber ribs 60 spaced across the length of the roller 21. The roller 21 rotates on shaft 62. FIG. 20 also illustrates how the series of peel fingers 56 are arranged to align with and penetrate into the bottoms of the grooves between the series of ribs 60.

Figure 21:
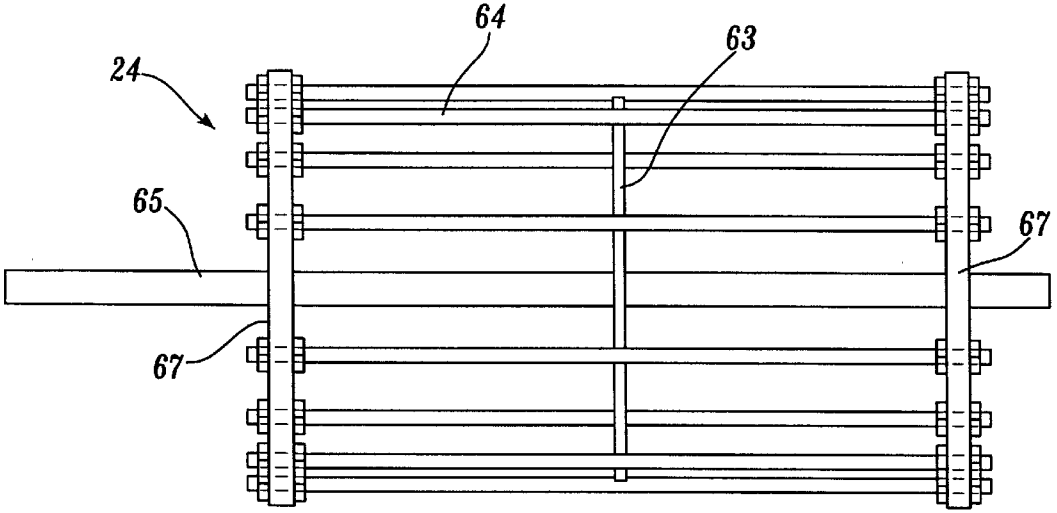
FIG. 21 illustrates a front view of the hydrated material infeed sprocket.
Figure 29:
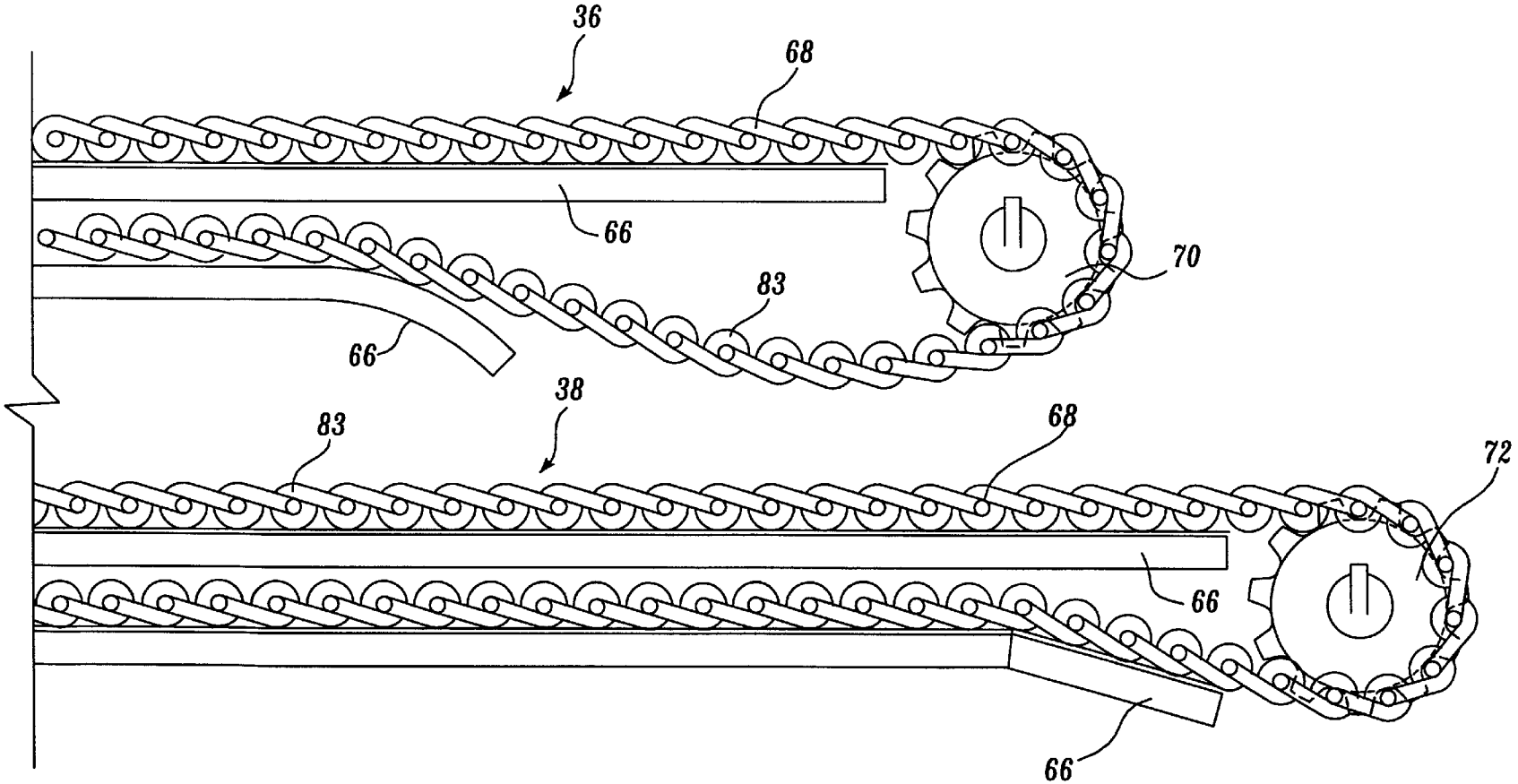

FIG. 21 illustrates a front view of the hydrated material feed sprocket 24. The sprocket 24 is designed like a reel and comprises a series of parallel spokes 64 arranged axially around the circumference of the sprocket 24 and at a uniform radial distance from central rotation shaft 65. The spacing between the spokes 64 is stabilized by a central disk 63 positioned between two end disks 67. The central disk 63 is designed to run in a linear groove created by the longitudinal web between adjacent cells 6 of the material 2 and thereby assists in guiding and tracking the hydrated material 30, after it has been withdrawn from the hydration tank 22.

Figure 22:
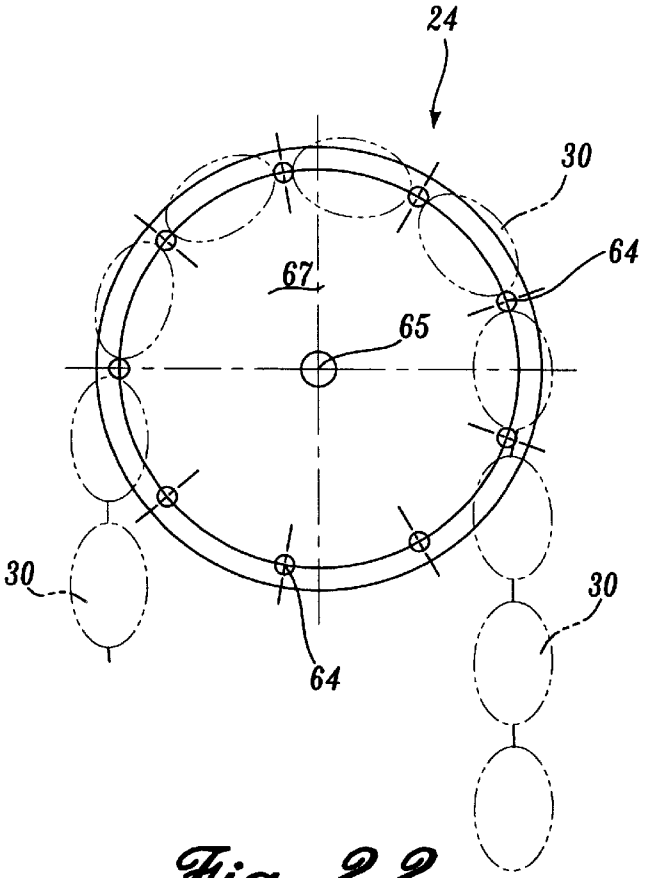
FIG. 22 illustrates an end view of the in-feed sprocket showing the hydrated material in dotted lines.

FIG. 22 illustrates an end view of the hydrated material feed sprocket 24. The spokes 64 are arranged in spatial parallel series around the circumference of the wheel 24, with the ends of the spokes 64 extending through the two end disks 67. FIG. 22 also illustrates how the series of swollen hydrated cells of the hydrated material 30, after passing through the hydration tank 22 (see FIG. 14) have assumed an oval shape, and each cell fits precisely within a space between adjacent spokes 64. This configuration enables the sprocket 24 to accurately count the hydrated cells of the hydrated material 30 as they emerge from the hydration tank 22, and before entering the freeze chamber 26. Counting of the cells can be done by a proximity sensor or a micro switch. This second hydrated cell count data is transmitted to the central microprocessor (PLC) and is coordinated with the first non-hydrated cell count data that is counted by non-hydrated cell counter wheel 19, before the material 2 passes into the hydration tank 22. The non-hydrated cell and hydrated cell count data must be coordinated with one another so that there is no undue tension placed upon the non-hydrated material 2 as it is drawn into the hydration tank 22, and the hydrated material 30 that is drawn out of the hydration tank. An adjustment in the cell count data must be made by the central microprocessor (PLC) because the oval shaped hydrated cells 30, as seen in FIG. 22, due to their swollen condition, tend to shorten the overall length of the hydrated material 30 compared to the unhydrated material 2. Individual sprockets 24 of different sizes can be used to accommodate different sizes of material 2, with different sizes of cells 6.

The infeed sprocket 24 is an important and unique part of the overall hydration-freezer apparatus 12. The sprocket 24 is driven by a variable frequency three phase gear motor. It is the primary speed regulator for the overall hydration-freezing process. The cell count determined by the sprocket 24 governs in turn the speed of the drive roller 20, which is driven separately. The coordination between the infeed sprocket 24 and the drive roller 20, as determined by the central microprocessor (PLC), ensures that the hydration material 2 has the proper residence time in the water in the hydration tank 22 (approximately 20 to 30 minutes) so that 100% hydration is achieved. As an option in certain cases, it may be desirable to hydrate to less than 100%. The central computer (PLC) can be programmed to do this.

FIG. 23 illustrates an elevation of one end of the third and fourth hydrated material conveyors 36, 38 located in the freezing chamber 26 of the hydration-freezing apparatus, below top conveyor 32 and the top chain belt conveyor 34 (see FIG. 9). As seen in FIG. 23, the right end of the upper conveyor 36 is spatially positioned above and short of the right end of the underlying conveyor 38. The top belt of conveyor 36 runs to the right while the top belt of conveyor 38 runs to the left. Since the terminus of the right end of upper conveyor 36 is located to the left of the terminus of the right end of underlying conveyor 38, the hydrated material 30, when it reaches the right end of upper conveyor 36, drops downwardly onto the top surface of the underlying conveyor 38, which then conveys the material 30 in the opposite direction.

FIG. 23 particularly illustrates how respective conveyor chain belts 68, 68 travel along the tracks 66 of the respective third conveyor 36 and fourth conveyor 38. The third conveyor chain belt 68 is driven by sprocket wheel 70 while the corresponding conveyor chain belt 68 on fourth conveyor 34 is driven by conveyor belt sprocket wheel 72. The sprocket wheels 70, 72 and so on, are all driven from a common power source to ensure that they all travel at the same velocity. It is important that there is no undue tension or bunching of the wet hydrated sandwich material 30 as it is being frozen during its switch-back passage through the freeze chamber 26 along the series of conveyor belts 32, 34, 36, 38 and 40.

The conveyor chain belts 68 which travel continuously along the respective conveyor belt tracks 66 for all conveyors, except the top conveyor 32, are available from Cambridge Wire Belt, Maryland. The conveyor belt track 68 is typically formed of 18-8 stainless steel rods to prevent corrosion. Furthermore, the lateral stainless steel rods are flexibly interconnected at each end in the form of knuckles 83 so that they can travel around the drive sprockets 70 and 72 without difficulty. The lateral cross bars of the conveyor belt 68 by being spaced apart enable chilled air from the blowers 42 to be easily circulated across the underside of the hydrated material 30 and thereby facilitate freezing.

Figure 24:
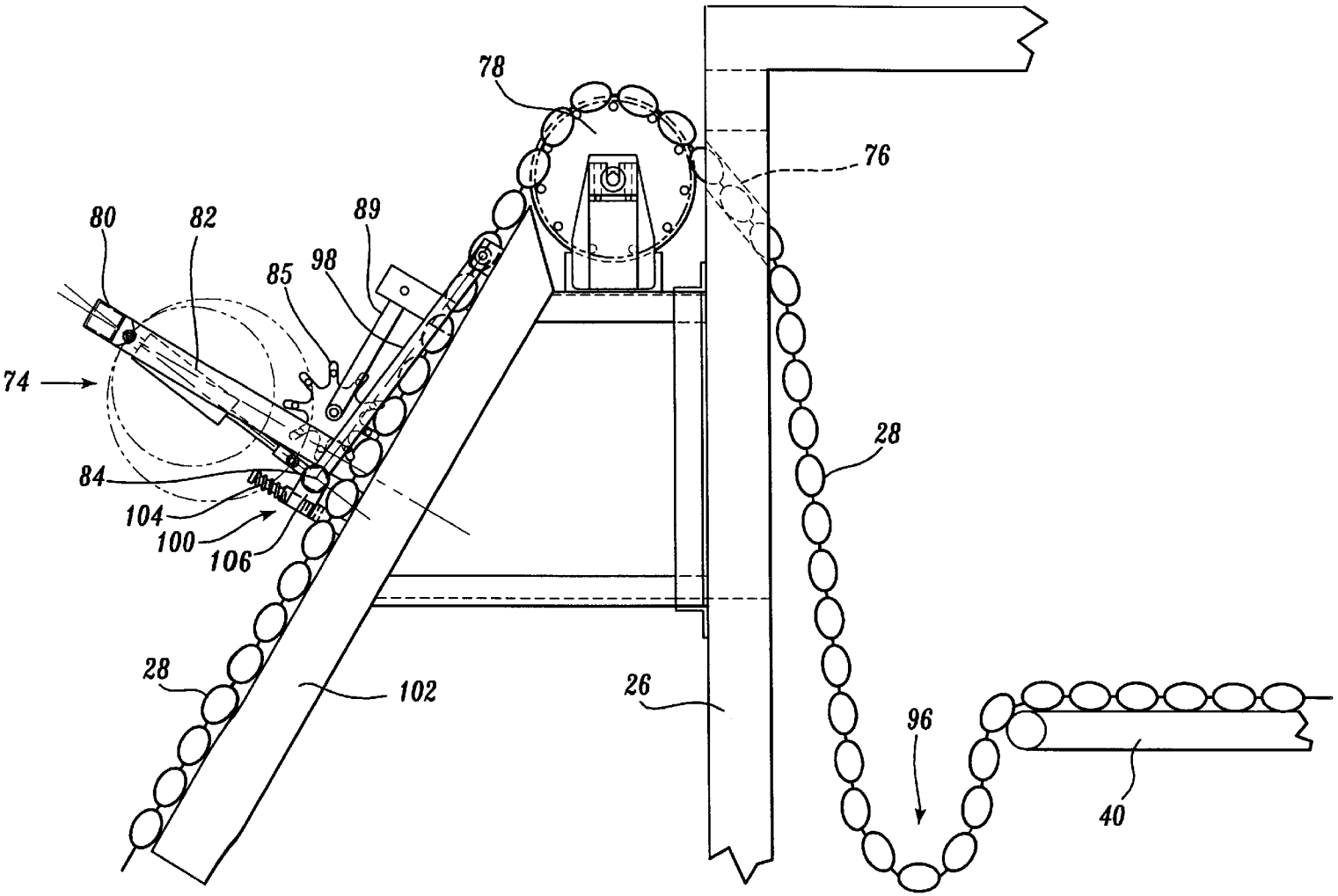
FIG. 24 illustrates a side view of an outfeed sprocket, and frozen material bight and a cutting assembly mounted on an inclined table.

FIG. 24 illustrates an partial section elevation view of the frozen hydrated material cutter assembly 74. The cutter assembly 74 is located outside the outfeed end of the freeze chamber 26 and draws frozen material 28 from the end of the lowest conveyor 40 (see FIG. 9). The frozen material 28, after it leaves the end of conveyor 40, passes through a bight zone 96 and is then drawn through a slot 76 in the end of the freeze chamber 26 by outfeed sprocket 78. The speed of the outfeed sprocket 78 is the same as the infeed sprocket 24, and they can be driven from a common source. The infeed sprocket 24 and the outfeed sprocket 78 are kept in lockstep with one another so that the cells of the hydrated material 30 fit precisely in the spokes of each sprocket.

The cutter assembly 74 is constructed of a rectangular gantry 80 (see FIG. 25) which is perpendicular to an inclined cutting table 102. An air cylinder 82 at its top end is connected by a clevis to the centre top of the gantry 80. The bottom end of the air cylinder 82 is connected by a clevis to the centre point of a laterally extending torque tube 84. Torque tube 84 is connected to the end of pivot arm 98, and can move upwardly or downwardly in an arc relative to the inclined table 102. The torque tube 84 is connected by connecting bars 106 to a cutter head 100. The cutter assembly 74 is positioned at right angles on the inclined table 102. The air cylinder 82, when activated, drives the torque tube 84 downwardly, which through connecting bars 106 activates the cutter head 100 as explained below in association with FIGS. 26 and 27.

The tension created by the suspension of the frozen material 28 in the bight zone 96 pulls the cells apart and widens the webs 94 between the cells thereby facilitating cutting. The bight 96 also allows some tension leeway between the outfeed sprocket 78 and the infeed sprocket 24 so that undue tension is not placed on the frozen material 28 at any time. The degree of inclination of the table 102 is a balance between ensuring that the frozen material 28 contacts the table 102 by gravity, and utilizing the effect of free gravity to draw the frozen material 30 downwardly from the sprocket 78.

For reliability in counting and material driving, it is advantageous that the frozen material 28 pass over and contact as much of the upper surface of the outfeed sprocket 78 as possible. This overall "wrap" is accomplished by a combination of having the frozen material 28 pass through the bight zone 96 on the upstream side of the outfeed sprocket 78 thereby ensuring that the frozen material 28 approaches the outfeed sprocket 78 at a steep angle, and mounting the cutter assembly 74 at right angles on an inclined table 102 on the downstream side of the sprocket 78.

The star wheel counter 85 is pivotally mounted on an arm 89 and rotates as the cells of the frozen material 28 pass under it. The spacing of the spokes of the star wheel counter 85 is the same as the distance from one cell to the next. The spokes of the star wheel counter 85 run over the longitudinal bulging centre-line of the series of cells so that the cells are accurately counted. After being cell counted by star wheel counter 85, the frozen material 28 passes under torque tube 84 and through the cutter head 100.

Figure 25:
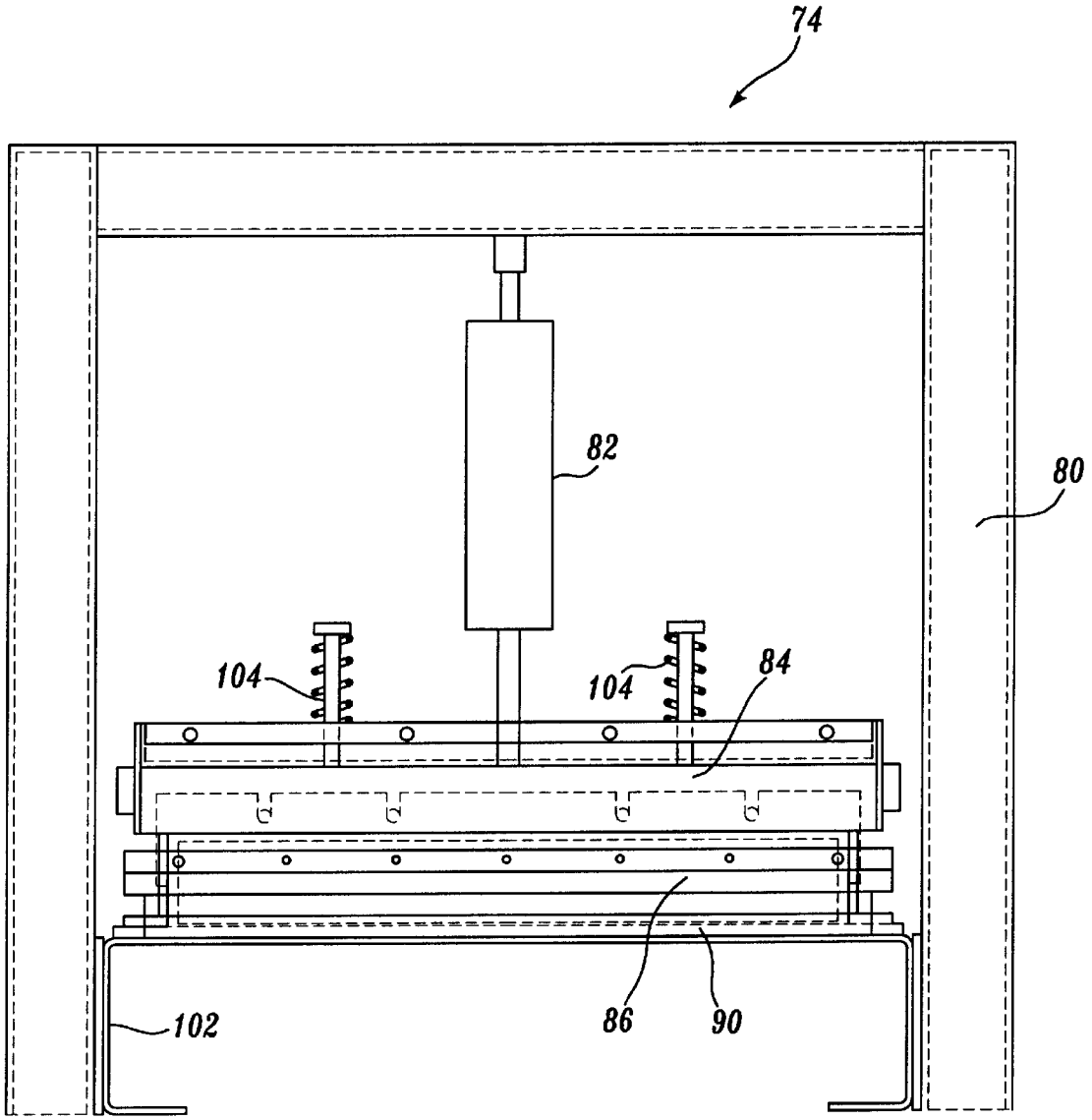
FIG. 25 illustrates an end view of the cutting assembly depicted in FIG. 24.

FIG. 25 illustrates an end view of the cutter assembly 74 mounted on the table 102. The air cylinder 82 is connected by a clevis at its top end to the centre point of the gantry 80 and at its lower end to the centre of the torque tube 84. The laterally extending torque tube 84 ensures that the knife blade 88 does not cant or tilt laterally and thus descends evenly across the width of the frozen material 28.

Figure 26:
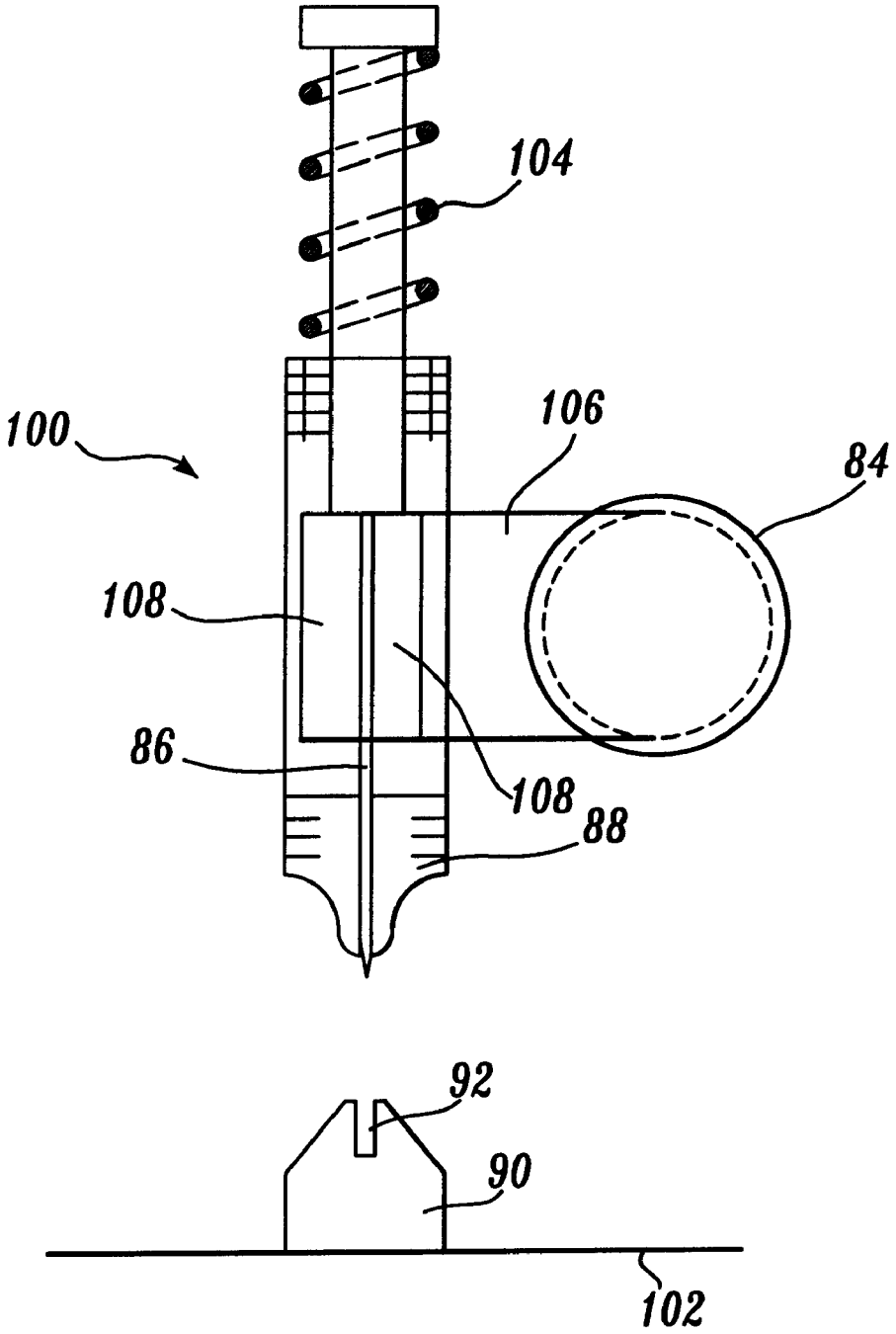
FIG. 26 illustrates an enlarged side partial section view of the cutting head.

FIG. 26 illustrates a detailed side view of the cutter head 100. The cutter head 100 is constructed of a torque tube 84 which is connected by connecting bars 106 to a pair of knife mounts 108 which are located on each side of the blade 86 and hold the blade 86 between them. The knife mounts 108 are bolted together. Knife blade 86 moves upwardly and downwardly in web centering knife-guide 88, which is preferably formed of a suitable low friction plastic such as polyethylene or polypropylene. Thus the knife 86 can slide easily upwardly and downwardly in the interior of the web centering guide 88. Underlying the bottom sharp edge of the knife 86 is an anvil 90, with a blade slot 92 formed in the top surface thereof. The anvil 90 is mounted laterally on the table. In rest position, the knife 86 and web centering guide 88 are in an upper position as shown in FIG. 26. The return spring 104 maintains the knife 86 in an upper position unless the knife 86 is driven downwardly by the air cylinder 82 (see FIGS. 24 and 25).

Figure 27:
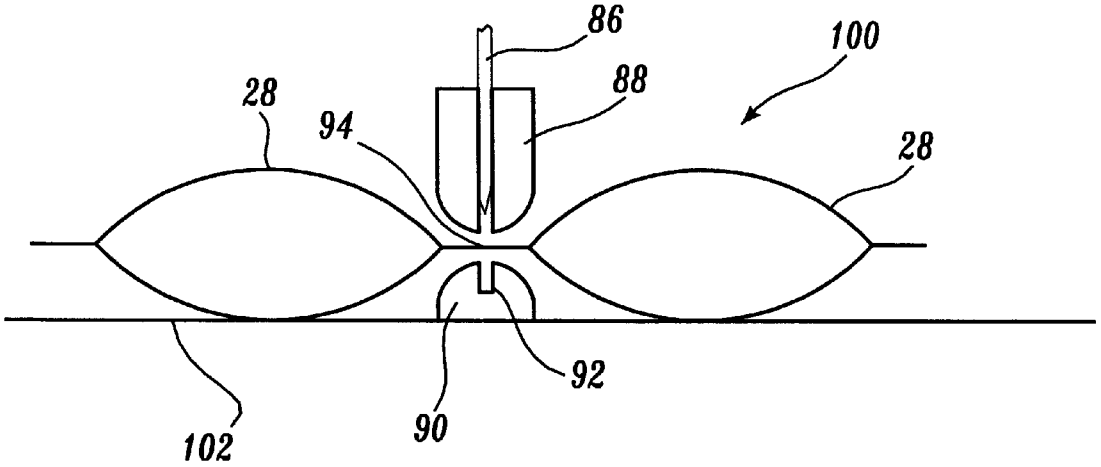
FIG. 27 illustrates a detailed elevation section view of a part of the frozen-hydrated material cutting head.

FIG. 27 illustrates a detail side view of the lower end of the cutter head 100 with knife 86 and web centering guide 88 interacting with the web 94 between adjacent cells of the frozen material 28. The web 94 is in position over the anvil 90. When the passage of a predetermined number of cells is counted by the star wheel counter 85 and microprocessor (PLC), and the cells pass under knife 86 and web centering guide 88, while in the upper position, the microprocessor signals the air cylinder 82 to cause the knife 86 and centering guide 88 to descend. The web centering guide 88 and the knife 86 are then quickly lowered by the air cylinder 82 and the centering guide 88 centres onto the web 94 between the cells. The centring guide 88, by descending between adjacent cells of the frozen material 28 ensures that the knife 86 is correctly positioned above the centre of the web 94. Once the centering guide 88 is aligned with the web 94, the knife 86 continues downwardly. The knife 86 then descends downwardly in the space within centering guide 88 and protrudes from the bottom thereof. It then cuts the web 94 between the adjacent swollen frozen cells of frozen material 28 by penetrating through the web 94 and into slot 92 of bottom blade anvil 90. The frequency of the cutting operation is determined by programming the PLC and utilizing the cell count of the web cutting cell detector star wheel counter 85 located immediately ahead of knife cutter assembly 74. The count data from the star wheel 85 is fed to the central microprocessor (PLC) which according to program activates the air cylinder 82 which operates the knife 86 and centering guide 88. In this way, the frozen hydrated material 28 can be cut into prescribed lengths.

Figure 28:
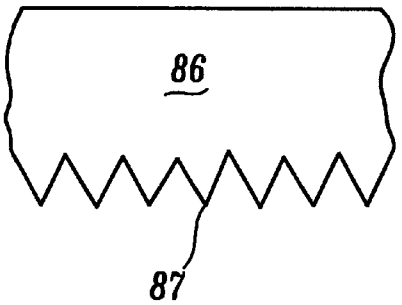
FIG. 28 illustrates a front view of a portion of the cutting blade of the cutting assembly.

FIG. 28 illustrates a front view of a portion of the knife 86 and bottom cutting teeth 87. The saw-like cutting teeth 87 assist in cutting the web 94 between the adjacent cells of the frozen material 28 because the lower points of each tooth penetrate the web 94 first. Then subsequently the sharp sides of the teeth 87 continue to cut as the knife 86 descends. This saw-tooth configuration for the cutting edge of the knife is advantageous because the lower points of the teeth 87 quickly engage the web 94 and do not let the web 94 squirm. The saw-tooth configuration is preferable to a straight edge blade, which might tend to cause the web 94 to move or squirm as it is cut by a downward movement of the blade 86.

It is important that the knife 86 cut the web 94, and not a part of either adjacent cell of the frozen material 28. If either cell is cut, the hydrated frozen granules leak out and the frozen hydrated material must be discarded. The loose frozen granules can also undesirably end up on the product being packaged or in the package itself.

Operation of Fully Automatic Hydration Freezer

The fully automatic self-contained hydration-freezer-cutter is designed to take Dynetherm™ hydration gel material from continuous rolls, hydrate it under precisely controlled conditions, pass it through a freezing chamber where it is fully frozen before passing out the other end and cutting the hydrated frozen material to prescribed lengths. It incorporates all the following features and characteristics:

(1) One person is able to start and monitor the whole operation, with sufficient time to collect and transport the frozen material into storage or participate in the packaging operation at the times when the hydrated frozen material is dispensed directly into a packing line.

(2) The hydration process is precisely controlled by a computer (PLC) which counts the cells of the unhydrated and hydrated Dyndtherm material going into and coming out of the hydration tank. This feature, combined with a large hydration tank, allows hydration times of anywhere from three to thirty minutes to be selected and precisely maintained.

(3) The transportation train for the unhydrated and hydrated Dynetherm material is made entirely of corrosion resistant materials, which guarantee long, maintenance free life. The speed of flow of the Dynetherm material through the apparatus is adjustable and can be readily changed by using simple front panel controls and a keyboard connected to the microprocessor (PLC). Therefore, if the freezer is used to produce material directly into a packing line, any reasonable discharge speed may be selected, down to as low as 30% of maximum.

(4) The cutting assembly at the outfeed end of the apparatus is fully automated by the PLC thereby allowing the operator to select by keyboard or panel controls, the length and number of cells of the frozen Dynetherm material to be cut.

(5) Refrigeration is supplied by a semi-hermetic compound compressor with a water cooled condenser. The condenser requires approximately 75 gallons/minute of cooling water. In most cases the water comes from a cooling tower which reduces the required amount of water input to a few gallons per hour.

Hydration-Freezer Control Requirements

The operation of the entire automatic hydration, freezing and cutting apparatus is controlled by a central programmable microprocessor (PLC). Sensors and the like, located at all critical locations, sense and transmit critical data to the central microprocessor (PLC).

| PLC Inputs: | | |
|---|---|---|
| (1) | Roll end detector | Opens when end of roll is reached |
| (2) | Hydration tank low level | Opens when water in hydration tank is low |
| (3) | Hydration tank infeed drive | Momentary contact push-button |
| (4) | Main drive "on" switch | Opens when off |

-continued

| PLC Inputs: | | |
|---|---|---|
| (5) | Remote all transports stop switch | A readily activated locking mushroom head NC |
| (6) | Refrigeration system "on" switch | Open when off |
| (7) | Cooling water thermostat | Closes on temperature rise |
| (8) | Condenser flow switch | Opens on low flow |
| (9) | High discharge pressure | Opens on pressure rise |
| (10) | Low suction pressure | Opens on pressure fall |
| (11) | High discharge temperature | Opens on temperature rise |
| (12) | Low oil pressure | Opens on rise |
| (13) | Defrost termination/fan delay | Closes to start fan |
| (14) | Web break detector | Optical detector opens on web break |
| (15) | First cell counter | Proximity sensor |
| (16) | Second cell counter | Limit switch |
| (17) | Web arrival sensor | Limit switch |
| (18) | Web cutting cell detector | Proximity sensor |
| (19) | Cutting air cylinder "end-of-out" stroke switch | Proximity sensor |
| (20) | Low air pressure switch | Opens on fall of pressure |
| (21) | Pull cord emergency stop | Opens on activation |

| PLC Outputs: | | |
|---|---|---|
| (1) | Main drive | 460 V VFAC 0.3 HP |
| (2) | Hydration tank in feed drive | 460 V VFAC 0.08 HP |
| (3) | Compressor crankcase heater | 460 V 180 W |
| (4) | Refrigeration compressor | 460 V 3 ph 30 HP |
| (5) | Water pump | 460 V 3 ph 1 HP |
| (6) | Tower fan | 460 V 3 ph 1 HP |
| (7) | Refrigerant liquid solenoid valve | 110 V AC 16 W |
| (8) | Water defrost solenoid valve | 110 v AC 16 W |
| (9) | Evaporator fans | 6 × 460 V 3 ph 1/2 HP |
| (10) | Cutting cylinder | 110 V AC 16 W |
| (11) | Alarm | 110 V AC |

Description of Devices Providing PLC Inputs:

(1) Roll end detector: A sensor arm 15 resting against the non-hydrated material on the supply roll 14 senses the imminent arrival (within 20 feet or so) of the end of the current roll 14. This alerts the operator so that he can connect a new roll to the end of the old roll 14.

(2) Hydration tank low water level: A float switch in the hydration tank 22 which senses low water level in the hydration tank 22 and sounds an alarm to provide the operator with a notification that the hydration tank is not operating correctly.

(3) Hydration tank infeed drive: A momentary contact push-button that initiates the filling of the hydration tank 22 with non-hydrated material 2 when the main drive has not yet run.

(4) Sequence start switch: A switch which starts the drive that powers all of the conveyors 32, 34, 36, 38 and 40 in the transport system as well as the infeed and outfeed sprocket wheels 24 and 72.

(5) Remote all transports stop switch: A readily activated mushroom head holding switch which is installed in one or more remote locations. It stops all transport conveyors in case of a jam up or break in the material.

(6) Refrigeration system "on" switch: A switch which begins the refrigeration of the freezer chamber 26 by enabling a liquid refrigerant solenoid valve.

(7) Cooling water thermostat: A control which starts the tower fan when the water temperature rises above a set-point.

(8) Condenser flow switch: A control which ensures that the compressor 46 cannot operate without adequate flow of refrigerant in the condenser 44.

(9) High discharge pressure switch: A manually resettable switch which stops the compressor 46 when the discharge pressure rises above a set-point.

(10) Low suction pressure switch: A switch which stops the compressor 46 when the suction pressure drops below a set-point.

(11) High discharge temperature switch: An automatic switch which stops the compressor 46 when the discharge temperature rises above a set-point.

(12) Low oil pressure switch: A manually resettable switch which stops the compressor 46 when the oil pressure drops below a set-point.

(13) Defrost termination/fan delay: An adjustable differential thermostat which is installed on the coil and senses temperature rise indicating the end of the defrost and also delays starting of the fan until the refrigeration system has brought the temperature of the evaporator coil down to prescribed levels.

(14) Web break detector: An optical sensor which opens the circuit if the material 2 should terminate some 8 to 12 inches before the first cell counter 19.

(15) First pocket counter: A proximity sensor 19 which detects and counts the individual non-hydrated cells going into the hydration tank 22.

(16) Second pocket counter: A microswitch on the sprocket 24 which detects the hydrated cells 30 coming out of the hydration tank 22. It counts the spokes of the infeed sprocket 24 only when another whisker sensor in series (not an input) proves the presence of the material 30 at the infeed sprocket 24.

(17) Web arrival sensor: A whisker type limit switch which detects the arrival of the frozen material web 28 above the floor after it drops off the end of the last conveyor 40.

(18) Web cutting cell detector: A proximity sensor which detects the precise angular position of the star wheel counter 85 to thereby signal the precise position of the frozen cells 28 as they pass under the cutter head 100 at the discharge of the freezer. The cutter head 100 can then be synchronized with the web areas 94 between cells. The sensor also serves to count the cells for cutting to length and to record total quantities produced.

(19) Cutting air cylinder—end of out stroke switch: This is a limit switch which indicates that the air cylinder 82 has reached the end of its downward stroke and has completed the cut.

(20) Low air pressure switch: An air pressure switch which indicates and sets off an alarm when air pressure supply drops below a set minimum.

(21) Pull cord emergency stop: A latching switch which is operated by a pull cord in the freezer. It stops all mechanical movement, evaporator fans and the flow of refrigerant in case of an emergency in the freezer chamber 26.

Description of Devices Controlled by PLC Output:

(1) Main drive: This is a settable variable frequency drive that powers the entire transport system from out of the hydration tank 22 and through the freezing chamber 26. The speed of the drive is settable at an operator control panel.

(2) Hydration tank infeed drive: This is a variable frequency drive which drives the pinch rollers 20, 21 that feed the non-hydrated web 2 into the hydration tank 22.

(3) Compressor crankcase heaters: These are required to drive refrigerant out of the compressor oil sump whenever the power has been disconnected from the machines for more than twelve hours.

(4) Refrigeration compressor: A 30 HP motor which is started when all its control circuits are closed.

(5) Water pump: A pump which is turned on and must be running whenever either the compressor or the defrost system is on.

(6) Tower fan: A fan which is started when required in response to rising temperature of the cooling water as registered by the cooling water thermostat.

(7) Refrigerant liquid solenoid valve: A solenoid valve which feeds liquid to the evaporator thereby indirectly starting the refrigeration compressor by raising the suction pressure in the evaporator.

(8) Water defrost solenoid valves: A defrost process is initiated at regular timed intervals by shutting off the liquid line solenoid valves, allowing the compressor 46 to pump down the evaporators for a minute, then shutting off the evaporator fans and five seconds later opening the water valves to melt all the ice from the cooling coils 43. The compressor continues to run as needed for pump-down throughout but the economizer, fans and liquid solenoid valve remain shut off.

(9) Evaporator fans: These fans, which circulate air around the freezer chamber 26, are turned on whenever the refrigeration system has been on long enough to reset the defrost termination/fan delay thermostat.

(10) Cutting air cylinder solenoid valve: This is a pneumatic 4-way valve which operates the air cylinder 82 of the web cutter assembly 74.

(11) Alarm: An audible alarm which indicates to nearby personnel that the roll 14 is about to end and that a new roll needs to be spliced on. It also alerts the operator to various other fault conditions such as web break, low water level, etc.

The Operation of the Hydration Freezing and Cutting Apparatus

The operation of the apparatus begins by filling the hydration tank 22 with water. While the tank 22 is filling, the web of material 2 can be threaded through the hydration tank infeed pinch rollers 20, 21 and under the stationary tank bottom roller 58. When the hydration tank 22 is full of water, and the material 2 has been threaded and the infeed pinch rollers 20, 21 have been re-engaged, the hydration tank infeed drive is started and the necessary number of cells of material 2 is fed into the tank 22. When the full prescribed cell count is in the tank 22 and the first few cells have been sufficiently hydrated, they are manually led over the infeed sprocket 24 after which the main transport is started.

As soon as the operator determines that the travel of the hydrated material 30 has been positively established over the infeed sprocket 24 and on the top conveyor 32, the operator starts the refrigeration system. For the operator, this consists of turning on the refrigeration system on/off switch. The PLC controls the refrigeration process and protects the refrigeration devices according to well established refrigeration practices. The PLC starts this process by starting the water pump and opening the refrigerant liquid solenoid valve.

The PLC performs the refrigeration system automatically by modifying and controlling the refrigeration system as required and activating a hot water spray system on the cooling coils when elimination of frost on the coils 43 is detected as being necessary. After defrost, the PLC stops hot water spray on the coils 43 and resumes normal refrigeration operations. The defrost procedure is initiated by closing the liquid line solenoid valves and letting the compressor 46 continue to run until the coil 43 is pumped down. Once the compressor 46 has stopped for the first time, the evaporator fans are stopped and the water defrost solenoid valve is opened. This valve is left open until the defrost termination/fan delay thermostat clicks over to high. When it does, the system returns to refrigeration mode but the fan does not come on again until the defrost termination/fan delay thermostat has switched back to low. An overriding defrost termination timer prevents a failure of the defrost termination/fan delay thermostat from leaving the system in perpetual defrost.

When the hydrated web of material has finished its passage through the freezer chamber 26 and has been fully frozen, the leading edge drops off the last conveyor 40 and descends to the floor where a leading edge arrival sensor, through an alarm, alerts the operator that the leading edge of the frozen web 28 has arrived at the discharge end. This time interval depends on enough cells having passed into the apparatus and therefore having dropped off the last conveyor 40 to allow the operator to take the end of the web 28 and drape it over the outfeed sprocket 78.

The PLC continues the main transport until sufficient frozen cells 28 have been accumulated for feeding into the cutting assembly 74. The operator then manually feeds the leading edge of the frozen web 28 into the cutting assembly 74. The star wheel counter 85 then begins counting the number of cells, and when that number matches a preset setting of the operational control, the PLC actuates the cutting knife centering guide 88 and cylinder directional solenoid valve to drive the centering guide 88 and the cutting blade 86 down through the web 94. An end of stroke sensor must be tripped to indicate that the cut has been completed before the cutting knife directional solenoid valve can be reversed.

The transport continues until the bulk of the roll 14 is used up. At the infeed end, where the non-hydrated material 2 is being pulled from the roll 14, a roll end detector 15 activates an alarm which alerts the operator that the end of the roll 14 is near. If the operator chooses to ignore this alarm and the end of the web arrives at the web break detector, the PLC will assume that this is intended to be the end of a production run and will allow the tail end of the material 2 to proceed through the rest of the apparatus.

If the web break detector is tripped while the roll end detector is 15 not, the PLC will first stop the hydration tank infeed drive for five minutes to allow the operator to resolve the problem. If the operator does not reset the web break alarm within five minutes, the PLC will stop the main transport.

As will be apparent to those skilled in the art in the light of the foregoing disclosure, many alterations and modifications such as alternative capacities, scale ups and scale downs are possible in the practice of this invention without departing from the spirit or scope thereof. Accordingly, the scope of the invention is to be construed in accordance with the substance defined by the following claims.

What is claimed is:

1. A process of continuously hydrating freezing and cutting a web of material having, a plurality of cells containing a hydratable polymer, the process comprising:

(a) counting the cells, (b) passing the web into a water hydration vessel for sufficient time to hydrate the hydratable polymer;

(c) withdrawing the web from the hydration vessel and passing the web through a freezer for sufficient time to enable the web to freeze; and (d) withdrawing the frozen web from the freezer and cutting the frozen web into prescribed lengths.

2. A process as claimed in claim 1 wherein the cells of the hydrated web are counted after being withdrawn from the hydration tank and before being passed through the freezer.

3. A process as claimed in claim 2 wherein before and after count data regarding the counted cells is transmitted to a microprocessor and the microprocessor controls the rate of entry of the web into and out of the hydration tank.

4. A process as claimed in claim 1 wherein the cells are vibrated before being counted.

5. A process as claimed in claim 1 wherein the hydrated and frozen web is cut between adjacent hydrated cells of the web.

6. A process as claimed in claim 5 wherein the hydrated frozen web passes through a bight zone before being cut.

7. A process as claimed in claim 5 wherein the web between adjacent hydrated cells is centered by a centering member and a knife cuts the web after the web is centered.

8. A process as claimed in claim 5 wherein the cells of the frozen hydrated web are counted and the count data is directed to a microprocessor which determines when the web should be cut.

9. An apparatus for continuously hydrating, freezing and cutting a web of material having a plurality of cells containing a hydratable polymer, the apparatus comprising:

(a) a source from which the unhydrated polymer containing web can be drawn;

(b) a first cell counter which counts unhydrated polymer containing cells in the web;

(c) a hydration tank through which the web drawn from the source is passed for sufficient time to hydrate the polymer in the web;

(d) a freezer associated with the hydration tank for freezing the web that has been hydrated in the hydration tank, and (e) a cutter for cutting the frozen hydrated web into prescribed lengths.

10. An apparatus as claimed in claim 9 including a pair of rollers which withdraws the web from the source.

11. An apparatus as claimed in claim 10 including a sprocket which withdraws hydrated polymer containing web from the hydration tank and transports the hydrated polymer containing web into the freezer.

12. An apparatus as claimed in claim 11 wherein the sprocket counts the number of hydrated cells in the web and utilizing a microprocessor coordinates the cell count for the hydrated web with the cell count for the unhydrated web, as counted by the first cell counter.

13. A process of continuously hydrating, freezing and cutting a hydratable polymer containing web of material which comprises:

(a) passing the web between a pair of pinch rollers;

(b) passing the web into a water hydration vessel for sufficient time to hydrate the hydratable polymer;

(c) withdrawing the web from the hydration vessel and passing the web through a freezer for sufficient time to enable the web to freeze; and (d) withdrawing the frozen web from the freezer and cutting the frozen web into prescribed lengths.

14. A process as claimed in claim 13 wherein the hydrated web, after it is withdrawn from the hydration tank, is passed through the freezer on conveyors.

15. An apparatus for continuously hydrating, freezing, and cutting a hydratable polymer containing web which comprises:

(a) a source from which the unhydrated polymer containing web can be drawn;

(b) a hydration tank through which the web drawn from the source is passed for sufficient time to hydrate the polymer in the web;

(c) a freezer associated with the hydration tank for freezing the web that has been hydrated in the hydration tank; and (d) a cutter for cutting the frozen hydrated web into prescribed lengths:

and wherein the freezer includes a top conveyor, and at least one underlying conveyor, which together transport the hydrated polymer containing web through the interior of the freezer.

16. An apparatus as claimed in claim 15 wherein the surface of the top conveyor is treated with a water release agent to deter wet hydrated polymer containing web from adhering to the top conveyor.

17. An apparatus as claimed in claim 15 wherein the underlying conveyor is constructed of a belt of spaced and flexibly interconnected rods.

18. An apparatus as claimed in claim 15 including at least one freezer blower which circulates frigid air within the interior of the freeze chamber and about the conveyors.

19. An apparatus for continuously hydrating, freezing, and cutting a web of material having a plurality of cells containing a hydratable polymer, the apparatus comprising:

(a) a source from which the unhydrated polymer containing web can be drawn;

(b) a hydration tank through which the web drawn from the source is passed for sufficient time to hydrate the polymer in the web;

(c) a freezer associated with the hydration tank for freezing the web that has been hydrated in the hydration tank; and (d) a cutter for cutting the frozen hydrated web into prescribed lengths;

and wherein the cutter includes a blade with an associated interface centering device, which cuts the hydrated frozen web at an interface between adjacent frozen hydrated cells.

20. An apparatus for continuously hydrating, freezing, and cutting a web of material having a plurality of cells containing a hydratable polymer, the apparatus comprising:

(a) a source from which the unhydrated polymer containing web can be drawn;

(b) a hydration tank through which the web drawn from the source is passed for sufficient time to hydrate the polymer in the web;

(c) a freezer associated with the hydration tank for freezing the web that has been hydrated in the hydration tank; and (d) a cutter for cutting the frozen hydrated web into prescribed lengths;

and wherein a sprocket withdraws frozen hydrated web from the freezer and transports the frozen hydrated web to the cutter.

21. An apparatus as claimed in claim 20 including a cell counter which counts frozen hydrated cells in the web and directs the cell count to the microprocessor, which determines the prescribed length when the web should be cut by the cutter.

* * * * *

UNITED STATES PATENT AND TRADEMARK OFFICE

CERTIFICATE OF CORRECTION

PATENT NO. : 6,170,268 B1
DATED : January 9, 2001
INVENTOR(S) : G.E. Elfert et al.

It is certified that error appears in the above-identified patent and that said Letters Patent is hereby corrected as shown below:

Title page,
Item [54], Title,
"METHOD AND APPARATUS FOR AUTOMATICALLY HYDRATING, FREEZING AND PACKAGED HYDRATION MATERIAL"
should read -- METHOD AND APPARATUS FOR AUTOMATICALLY HYDRATING, FREEZING AND CUTTING PACKAGED HYDRATION MATERIAL --

Column 1,
Lines 1-3, "METHOD AND APPARATUS FOR AUTOMATICALLY HYDRATING, FREEZING AND PACKAGED HYDRATION MATERIAL"
should read -- METHOD AND APPARATUS FOR AUTOMATICALLY HYDRATING, FREEZING AND CUTTING PACKAGED HYDRATION MATERIAL --

Signed and Sealed this

Eleventh Day of December, 2001

*Attest:*

Nicholas P. Godici

NICHOLAS P. GODICI
*Acting Director of the United States Patent and Trademark Office*

*Attesting Officer*